US009777997B2

(12) United States Patent
Swan et al.

(10) Patent No.: US 9,777,997 B2
(45) Date of Patent: Oct. 3, 2017

(54) PLATE CARRIER APPARATUS AND METHOD

(75) Inventors: Johnny E. Swan, Virginia Beach, VA (US); Andrew C. Borland, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 1484 days.

(21) Appl. No.: 13/506,182

(22) Filed: Apr. 2, 2012

(65) Prior Publication Data

US 2013/0084764 A1 Apr. 4, 2013

Related U.S. Application Data

(63) Continuation-in-part of application No. 29/395,765, filed on Mar. 27, 2012, now Pat. No. Des. 677,433.

(60) Provisional application No. 61/626,784, filed on Oct. 3, 2011.

(51) Int. Cl.

| | |
|---|---|
| ***A41D 27/26*** | (2006.01) |
| ***F41H 1/02*** | (2006.01) |
| ***A41D 13/05*** | (2006.01) |

(52) U.S. Cl.

CPC ..... *F41H 1/02* (2013.01); *A41D 13/0518* (2013.01); *Y10T 29/49826* (2015.01)

(58) Field of Classification Search

CPC ..... A41D 13/015; A41D 13/0153; A41D 31/0055; F41H 5/08; F41H 1/02; F41H 5/013

See application file for complete search history.

(56) References Cited

U.S. PATENT DOCUMENTS

| | | | | |
|---|---|---|---|---|
| 642,649 | A * | 2/1900 | Vaughan | 2/2.5 |
| 1,107,040 | A | 8/1914 | Conde | |
| 1,610,092 | A | 10/1924 | Hise | |
| 1,613,203 | A | 1/1927 | Shannon | |
| 1,946,059 | A | 2/1934 | Buchholz et al. | |
| 2,236,736 | A | 9/1938 | Scott | |
| 2,296,287 | A | 9/1942 | Leyde | |
| 2,346,695 | A | 4/1944 | Miller | |
| 2,545,419 | A | 3/1951 | Williams | |
| 2,837,630 | A | 6/1958 | Shen | |
| 2,972,739 | A | 2/1961 | Opper | |

(Continued)

OTHER PUBLICATIONS

Design U.S. Appl. No. 29/395,765, Plate Carrier Vest, filed Mar. 27, 2012, Johnny E. Swan and Andrew C. Borland.

*Primary Examiner* — Sally Haden

(74) *Attorney, Agent, or Firm* — Tanner IP, PLLC

(57) ABSTRACT

Embodiments include a method and apparatus for mounting wearable ballistic body armor plates and accessories to a user. Embodiments may include a plate frame assembly comprising one or more plate frames and one or more ballistic body armor plates. The one or more plate frames may at least partially house the one or more ballistic body armor plates and hold them in position with respect to the one or more plate frames. A method of embodiments may include providing one or more plate frames and one or more ballistic body armor plates and using the one or more plate frames to hold the one or more ballistic armor plates in a fixed position with respect to the body armor plates. In some embodiments, the plate frame assembly is resistant to the absorption and/or accumulation of liquids and chemicals.

8 Claims, 10 Drawing Sheets

(56) References Cited

U.S. PATENT DOCUMENTS 3,155,297 A 11/1964 Stumpf
3,348,746 A 10/1967 Stumpf
3,769,663 A 11/1973 Perl
3,834,052 A 9/1974 Steck, III
3,908,950 A 9/1975 Apel
4,004,493 A * 1/1977 Costanza ..... F41H 1/02 2/2.5
4,008,536 A 2/1977 Adams
4,216,600 A 8/1980 Brueckner et al.
4,462,064 A 7/1984 Schweitzer
4,504,001 A 3/1985 Nichols
4,639,944 A 2/1987 Lashley et al.
4,750,656 A 6/1988 Bianchi et al.
4,777,754 A 10/1988 Reynolds, Jr.
4,797,793 A 1/1989 Fields
4,905,396 A 3/1990 Bechtel
4,939,863 A 7/1990 Alexander et al.
5,014,892 A 5/1991 Copeland
5,018,653 A 5/1991 Shoemaker
5,033,219 A 7/1991 Johnson et al.
5,040,322 A 8/1991 Iturrey, Jr.
5,054,170 A 10/1991 Otrusina
5,070,437 A 12/1991 Roberts, Sr.
5,122,781 A 6/1992 Saubolle
5,165,782 A 11/1992 Maglica et al.
D332,172 S 1/1993 Lewis
5,203,624 A 4/1993 Schier et al.
D340,542 S 10/1993 Marlowe
5,265,781 A 11/1993 Nichols
5,267,131 A 11/1993 Anthony et al.
D352,165 S 11/1994 Covertson
5,400,008 A 3/1995 Toohey
5,414,405 A 5/1995 Hogg et al.
5,430,967 A 7/1995 Woodman, III et al.
5,436,814 A 7/1995 Hanley
5,438,494 A 8/1995 Harlan
5,469,346 A 11/1995 Haut et al.
5,477,559 A * 12/1995 Clement ..... A63B 71/1225 2/22
5,530,966 A * 7/1996 West ..... A61K 38/162 2/2.5
5,557,804 A * 9/1996 Ovortrup ..... A41D 13/0506 128/888
5,564,610 A 10/1996 Barron
5,598,958 A 2/1997 Ryan et al.
5,620,120 A 4/1997 Tien
5,622,297 A 4/1997 Rogers et al.
5,623,729 A * 4/1997 Chen ..... 2/461
5,633,623 A 5/1997 Campman
5,639,005 A 6/1997 Chouinard
5,644,792 A * 7/1997 Tishler ..... F41H 1/02 2/2.5
5,671,561 A 9/1997 Johnson et al.
5,697,695 A 12/1997 Lin et al.
5,716,121 A 2/1998 Dubois
5,735,594 A 4/1998 Own
5,771,489 A 6/1998 Snedeker
5,810,221 A 9/1998 Beletsky et al.
5,839,630 A 11/1998 Dunstan et al.
5,850,954 A 12/1998 Dong-Joo
5,865,524 A 2/1999 Campman
5,978,961 A 11/1999 Barker
5,996,115 A 12/1999 Mazelsky
6,012,827 A 1/2000 Caplan et al.
6,059,156 A 5/2000 Lehtinen
6,067,013 A 5/2000 Pejic
6,069,557 A 5/2000 Anglin, Jr. et al.
6,112,448 A 9/2000 Gray et al.
6,148,447 A 11/2000 Bain et al.
6,158,874 A 12/2000 Brustein et al.
6,161,741 A 12/2000 French
6,175,958 B1 1/2001 Wu
6,185,854 B1 2/2001 Solinsky et al.
6,190,018 B1 2/2001 Parsons et al.
6,190,025 B1 2/2001 Solinsky
6,213,623 B1 4/2001 Campman
6,276,088 B1 8/2001 Matthews et al.
D452,047 S 12/2001 Ditchfield et al.
6,371,625 B2 4/2002 Campman
6,393,752 B1 5/2002 Oliver et al.
6,478,441 B2 11/2002 Lam
6,499,245 B1 12/2002 Swan
6,578,311 B2 6/2003 Danielson et al.
6,616,294 B1 9/2003 Henry
6,685,067 B2 2/2004 French
6,722,771 B1 4/2004 Stephens
6,742,913 B2 6/2004 Deutsch
6,785,997 B2 9/2004 Oz
6,793,366 B2 9/2004 Chun
6,817,727 B1 11/2004 McFadden
6,910,224 B2 6/2005 Ikenaga et al.
6,955,279 B1 10/2005 Mudd et al.
6,976,777 B1 12/2005 Herold
7,021,790 B2 4/2006 Parsons
7,096,620 B2 8/2006 Zeh
7,156,536 B1 1/2007 McCorkle
7,195,370 B2 3/2007 Riblett et al.
7,218,142 B2 5/2007 Nozawa et al.
7,218,241 B2 5/2007 Kessel et al.
7,226,183 B2 6/2007 Galli et al.
7,267,453 B2 9/2007 Chang et al.
7,287,873 B2 10/2007 Galli
7,290,896 B2 11/2007 Dallas et al.
7,293,893 B2 11/2007 Kim
7,395,627 B2 7/2008 La France et al.
7,434,955 B2 10/2008 Vickers et al.
7,444,776 B2 11/2008 Adams
7,458,489 B1 12/2008 Mudd et al.
7,510,294 B2 3/2009 Steele et al.
7,517,108 B2 4/2009 Galli et al.
7,523,583 B2 4/2009 Cheng
7,534,006 B2 5/2009 Goswami et al.
7,562,484 B2 7/2009 Kim
7,682,037 B1 3/2010 Hose et al.
7,694,450 B2 4/2010 Keng
7,712,148 B2 5/2010 Carlson
7,731,385 B2 6/2010 Spartano et al.
7,735,255 B1 6/2010 Kincaid et al.
7,736,013 B2 6/2010 Griffin
7,743,547 B2 6/2010 Houde-Walter
D622,036 S 8/2010 Mason, III
7,827,724 B1 11/2010 Spinelli
7,836,625 B2 11/2010 Swan et al.
7,896,518 B2 3/2011 Holmes et al.
D640,417 S 6/2011 Haynes
D641,960 S 7/2011 Goff et al.
D648,489 S 11/2011 Stockard
D652,573 S 1/2012 Rodriguez
8,166,694 B2 5/2012 Swan
D666,363 S 8/2012 Culbertson
8,256,020 B2 9/2012 Dovner et al.
D677,433 S 3/2013 Swan et al.
8,444,291 B2 5/2013 Swan et al.
8,584,917 B2 * 11/2013 Hexels ..... A45F 3/08 2/102
9,003,947 B1 * 4/2015 Rittenhouse, Jr. ..... F41H 1/02 2/2.5
2002/0096545 A1 7/2002 Chang
2002/0148865 A1 10/2002 French
2003/0090893 A1 5/2003 Nepil
2003/0098323 A1 5/2003 Taylor et al.
2003/0123254 A1 7/2003 Brass et al.
2003/0141329 A1 7/2003 Huang
2004/0000083 A1 1/2004 Grant, Jr.
2004/0069821 A1 4/2004 Kobayashi
2004/0145889 A1 7/2004 Hendricks
2005/0010987 A1 1/2005 Crye et al.
2005/0180130 A1 8/2005 Harris et al.
2006/0026888 A1 2/2006 Cheng et al.
2006/0198132 A1 9/2006 Trigiani et al.
2006/0236583 A1 10/2006 Pikielny
2006/0253950 A1 11/2006 Kerr
2007/0079415 A1 4/2007 Carlson

(56) References Cited

U.S. PATENT DOCUMENTS

| | | | | |
|---|---|---|---|---|
| 2007/0230162 | A1 | 10/2007 | Galli et al. | |
| 2008/0205037 | A1 | 8/2008 | Griffin | |
| 2008/0235841 | A1 | 10/2008 | McDunn et al. | |
| 2009/0122527 | A1 | 5/2009 | Galli | |
| 2009/0151036 | A1 | 6/2009 | Joseph | |
| 2009/0185854 | A1 | 7/2009 | Adams | |
| 2009/0190332 | A1 | 7/2009 | Sharrah | |
| 2009/0293334 | A1 | 12/2009 | Swan | |
| 2010/0018103 | A1 | 1/2010 | Holmberg | |
| 2010/0128470 | A1 | 5/2010 | Swan et al. | |
| 2010/0192448 | A1 | 8/2010 | Darian | |
| 2010/0229450 | A1 | 9/2010 | Becker et al. | |
| 2011/0032694 | A1 | 2/2011 | Swan | |
| 2011/0131694 | A1 | 6/2011 | Fearon | |
| 2011/0209260 | A1 | 9/2011 | Herbener et al. | |
| 2011/0231985 | A1 | 9/2011 | Bishop | |
| 2011/0249432 | A1 | 10/2011 | Swan et al. | |
| 2011/0278339 | A1* | 11/2011 | Hexels | A45F 3/08 224/676 |
| 2012/0024924 | A1* | 2/2012 | Hexels | A45F 3/08 224/576 |
| 2012/0030986 | A1 | 2/2012 | Swan et al. | |
| 2012/0057360 | A1 | 3/2012 | Swan | |
| 2015/0082524 | A1* | 3/2015 | Ben David | A45F 3/04 2/463 |

* cited by examiner

PLATE CARRIER APPARATUS AND METHOD

CROSS-REFERENCE TO RELATED APPLICATIONS

This application claims benefit of U.S. provisional patent application Ser. No. 61/626,784, filed Oct. 3, 2011 and entitled "Plate Carrier Apparatus and Method," which is herein incorporated by reference. This application is also a continuation-in-part of U.S. design patent application Ser. No. 29/395,765 entitled "Plate Carrier Vest" filed on Mar. 27, 2012, now U.S. design patent number D677,433, having the inventors Johnny E. Swan and Andrew C. Borland, which is herein incorporated by reference.

BACKGROUND OF THE INVENTION

Field of the Invention

Embodiments generally relate to the mounting of wearable ballistic body armor plates and accessories to military and law enforcement personnel and other individual people.

Description of the Related Art

People in current military and law enforcement units are required to wear hard ballistic armor plates and flexible soft armor plates. In addition, the people in these units must also be able to carry extra equipment to allow them to accomplish their mission. Most of these extra pieces of equipment are typically carried by pouches worn by the individual person. These pouches plus the hard and soft armor pieces are attached to the upper torso of an individual via a soft material sewn in such a fashion that it carries these pieces. The resulting vest is typically referred to as a load bearing vest or tactical vest.

In an attempt to meet the demands of carrying a variety of tactical equipment, manufacturers must make tactical vest designs that have a modular attachment system, which adds unnecessary material and bulk to the tactical vest. These tactical vests are all sewn pieces of nylon material, which must wrap the armor plates and have a closure flap to prevent the plate from falling out.

The materials sewn are also not resistant to the absorption of liquids and chemicals. Once these materials become impregnated with a liquid that is harmful, they are considered useless and disposed of promptly. If the same tactical nylon material is immersed in water, it absorbs a substantial amount of water and takes on that unnecessary weight until it can be dried out.

As the demand increases to decrease the overall weight of this equipment and provide resistance to liquids and chemicals, the need exists to provide military and law enforcement units and other individuals an integrated light weight streamlined armor carrier.

SUMMARY OF THE INVENTION

Some embodiments generally provide an integrated light weight streamlined armor carrier.

Some embodiments generally provide an armor carrier which is resistant to liquid and chemicals.

Embodiments generally include a plate frame assembly wearable by a user to provide ballistic protection to the user, comprising a rigid plate frame; and one or more ballistic body armor plates, the one or more body armor plates at least partially housed in the rigid plate frame and held in a fixed position with respect to the rigid plate frame by the plate frame, the rigid plate frame having one or more built-in features for securing tactical equipment thereto.

Other embodiments generally include a method of forming a plate frame assembly, comprising providing an integrated rigid plate frame assembly having one or more holes therethrough for securing tactical equipment thereto; providing a ballistic body armor plate, the ballistic body armor plate for providing ballistic protection to a user; holding the body armor plate in a fixed position with respect to the integrated rigid plate frame using the plate frame; and providing one or more shoulder supporting members through the plate frame to support the plate frame assembly from the user's shoulders.

Other embodiments generally include a plate frame assembly wearable by a user to provide ballistic protection to the user, comprising a rigid plate frame; and one or more ballistic body armor plates, the one or more body armor plates attached to the rigid plate frame and held in a fixed position with respect to the rigid plate frame by the plate frame, the rigid plate frame having one or more built-in features for securing tactical equipment, one or more pockets, or one or more pouches thereto.

BRIEF DESCRIPTION OF THE DRAWINGS

So that the manner in which the above-recited features of embodiments of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments may include an integrated, generally rigid plate frame or plate carrier designed to hold ballistic armor plates in a fixed position with a decreased amount of surface material, weight and bulk compared to current vest designs.

Embodiments may include a non-sewn, soft material formed and fused to provide one or more pouches, straps and/or cummerbund.

In embodiments, one or more inflatable and/or non-inflatable bladders may be attached to an armor frame and cummerbund to increase buoyancy and comfort in the plate carrier. The bladder serves as a thin padding between the armor carrier and upper torso of the user.

In some embodiments, the integrated hard frame, cummerbund (which may be made of a soft material), pouch material, and inflatable/non-inflatable bladder(s) are resistant to absorption of liquids and chemicals.

Figure 6:
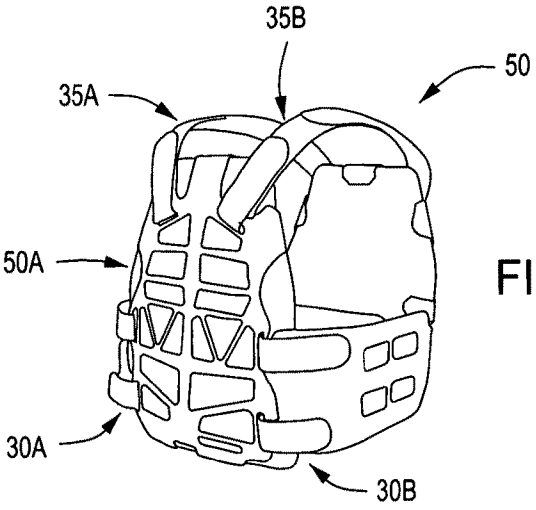
FIG. 6 is a perspective view of attachment straps on a plate frame assembly of embodiments.
Figure 5:
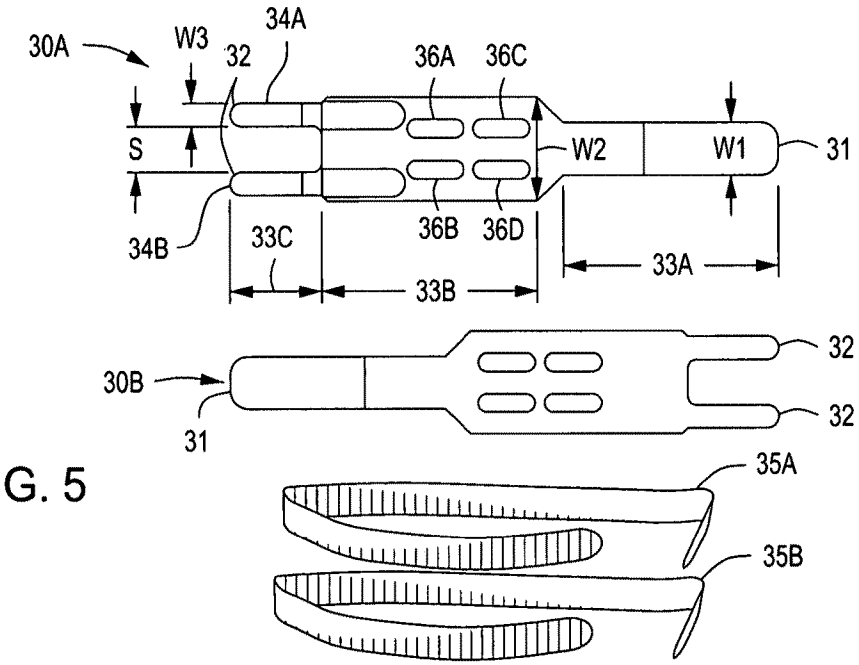
FIG. 5 is a perspective view of attachment straps of embodiments.

This frame 10 has features that allow the ballistic armor plate 20 to be attached to a user's body by one or more attachment straps such as attachment straps 30A, 30B, 35A, 35B (see FIGS. 5 and 6). The plate frame 10 also has built in features (e.g., holes therethrough) that allow tactical equipment to be attached to the plate frame 10.

Plate Frame 10 or Plate Carrier (see FIGS. 1-3 and 4)

The plate frame 10 or plate carrier, in some embodiments, is a rigid piece of material that securely grabs and retains a ballistic body armor plate 20. The plate frame 10 acts as a carrier of the body armor plate 20 and may frame the body armor plate 20. The plate frame 10 has unnecessary material removed to decrease the weight that is loaded on the user. The plate frame 10 could for example be made out of plastic, metal, and/or any other non-porous rigid material. By making the plate frame 10 out of these types of material, the plate frame is liquid, chemical, and biohazard resistant. These types of material can be easily decontaminated. Forming the plate frame from these types of material also eliminates any extra weight being added to the material when the plate frame is submerged in water.

The body armor plate 20, which is also a rigid piece of material in some embodiments, provides ballistic protection to the wearer. The body armor plate 20 may include any type or material of body armor plate which provides ballistic protection to the wearer known to those skilled in the art. The level of protection of the body armor plate is typically specified by the armor manufacturer and could range from protection from low velocity projectiles to protection from high velocity bullets. One example of materials which the body armor plate may be constructed from includes a formed, rigid ceramic plate with a soft woven Kevlar backing, the ceramic plate and backing sandwiched together into one singular plate.

The plate frame 10 may include a first plate frame portion 10A and a second plate frame portion 10B, the first and second plate frame portions 10A and 10B releasably connectible to one another via one or more attachment straps 30A, 30B, 35A, 35B. The body armor plate 20 may include a first body armor portion 20A and a second body armor portion 20B. The first body armor plate portion 20A may be secured to the first plate frame portion 10A by one or more plate frame extensions 12 which extend from the first plate frame portion 10A and wrap around the first body armor portion 20A to hold it in place with respect to the first plate frame portion 10A. Likewise, the second body armor plate portion 20B may be secured to the second plate frame portion 10B by one or more plate frame extensions 14 which extend from the second plate frame portion 10B and wrap around the second body armor plate portion 20B to hold it in place with respect to the second plate frame portion 10B.

Figure 3:
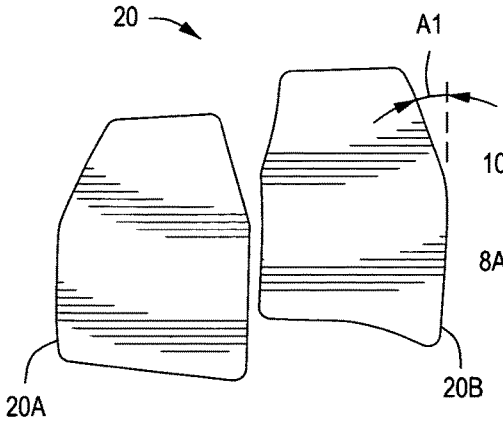
FIG. 3 is a perspective view of a body armor plate of embodiments.

The first body armor plate portion 20A and the second body armor plate portion 20B may be of generally the same size, shape, and configuration. As shown in FIG. 3, each body armor plate portion 20A, 20B may be generally curved around in shape to conform generally to the curves of a front and back of a person's torso. The curvature of the body armor plate portions 20A, 20B and the plate frame portions 10A, 10B may generally the same as or similar to standard curvatures of body armor plates in the industry, known to those skilled in the art. The body armor plate portions 20A, 20B may be mirror images of one another in their curvature and in their dimensions when placed with the inside of the curve of the body armor portions 20A, 20B facing one another. Approximately the lower half of a length of the body armor portions 20A, 20B may be generally equal in width, and approximately the upper half of the length of the body armor portions 20A, 20B may decrease in width gradually until the top of the body armor portions 20A, 20B is reached. This decrease in width of the upper half and uniform width of the lower half may be the same on each side of each respective body armor portion 20A, 20B, so that each body armor portion is symmetric over its length. The decrease in width at the upper half of the body plate portion 20B may be accomplished by an inward slope in the width of the upper half of the body plate portion 20B, forming an angle A1 of the body armor portion and an angle on the other side of the body armor portion which may be the same as angle A1 (a similar width decrease may be present in the body armor plate portion 20A). Of course, it is within the scope of embodiments that the body armor portions 20A, 20B are not mirror images of one another and do not have the same dimensions, curvature, etc. as one another. It is also within the scope of embodiments that the body armor portions 20A, 20B are of different lengths, widths, curvatures, angles, etc.

The plate frame 10 generally corresponds to the size, shape, and curvature of the body armor plate 20. In this regard, the first plate frame portion 10A generally corresponds to the size, shape, and curvature of the first body armor plate portion 20A, and the second plate frame portion 10B generally corresponds to the size, shape, and curvature of the second body armor plate portion 20B. The first plate frame portion 10A and the second plate frame portion 10B may be mirror images of one another in their curvature and dimensions (as defined by the outer edges of the plate frame portions 10A, 10B). Approximately the lower half of a length of the plate frame portions 10A, 10B may be generally equal in width, and approximately the upper half of the length of the plate frame portions 10A, 10B may decrease in width gradually until the top of the plate frame portions 10A, 10B is reached. This decrease in width of the upper half and uniform width of the lower half may be the same on each side of each respective plate frame portion 10A, 10B, so that each plate frame portion is symmetric over its length. An angle of the plate frame portion which corresponds with the angle A1 when the plate frame portion and body armor plate frame 20 are assembled together may be approximately the same as the angle A1 of the body armor plate frame 20. Of course, it is within the scope of embodiments that the plate frame portions 10A, 10B are not mirror images of one another and do not have the same dimensions, curvature, etc. as one another. It is also within the scope of embodiments that the plate frame portions 10A, 10B are of different lengths, widths, etc.

The plate frame 10 may include a number of holes therein of different sizes and shapes for performing various purposes, including for inserting the attachment straps therethrough and for attaching various equipment (e.g., tactical equipment such as pockets, pouches, backpacks, etc.) to the plate frame 10. The plate frame 10 may be designed as shown in the figures so that the holes therein are shaped to allow attaching of specific tactical equipment, pockets, pouches, backpacks, etc. to the holes. In one example which is not limiting of embodiments, the one or more pouches may have tabs that extend through the holes in the plate frame 10 and then wrap around the plate frame 10 back onto themselves, and the portions of the tabs which overlap themselves may be attached to one another using, for example one or more hook and loop fasteners (e.g., Velcro®) or what is referred to as a "tuck-tab." The first plate frame portion 10A may include first and second shoulder strap attachment holes 6A, 6B through a top portion of the first plate frame portion 10A, and the second plate frame portion 10B may include third and fourth strap attachment holes 7A, 7B through a top portion of the second plate frame portion 10B. In some embodiments, when the inside of the first plate frame portion 10A and the inside of the second plate frame portion 10B are facing one another, the first strap attachment hole 6A and the third strap attachment hole 7A correspond to one another and are generally in line with one another, and the second strap attachment hole 6B and the fourth strap attachment hole 7B correspond to one another and are generally in line with one another. To this end, the hole 6A may be disposed at a first position on the first plate frame portion 10A to generally correspond with a position of the right shoulder of the user when the plate frame 10 is placed on the user, and the hole 7A may likewise be disposed at a first position on the second plate frame portion 10B to generally correspond with a position of the right shoulder of the user when the plate frame 10 is placed on the user. The hole 6B may be disposed at a second position on the plate frame portion 10A to generally correspond with the left shoulder of the user when the plate frame 10 is placed on the user, and the hole 7B may be disposed at a second position on the second plate frame portion 10B to generally correspond with a position of the left shoulder of the user when the plate frame 10 is placed on the user.

Figure 1:
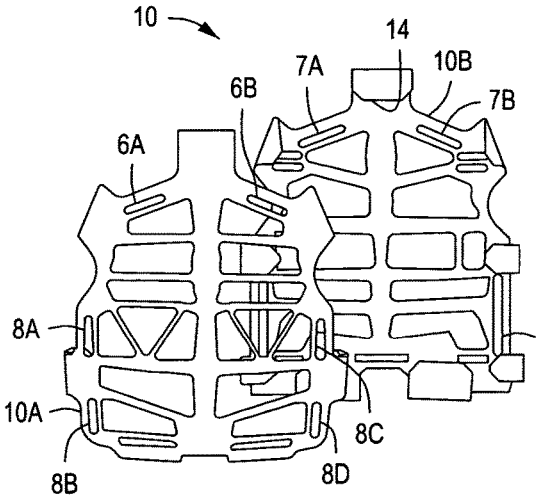
FIG. 1 is a perspective view of a plate frame of embodiments.
Figure 2:
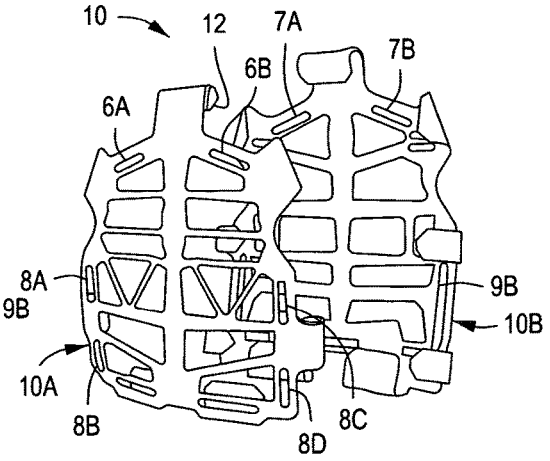
FIG. 2 is a perspective view of a plate frame of embodiments.
Figure 7:
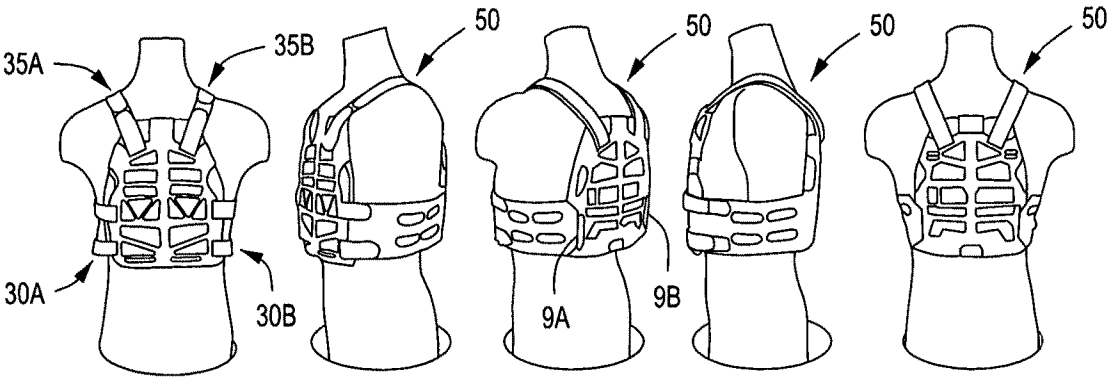
FIG. 7 shows multiple views of examples of how a plate frame assembly may be worn on a user's torso in embodiments.
Figure 8:
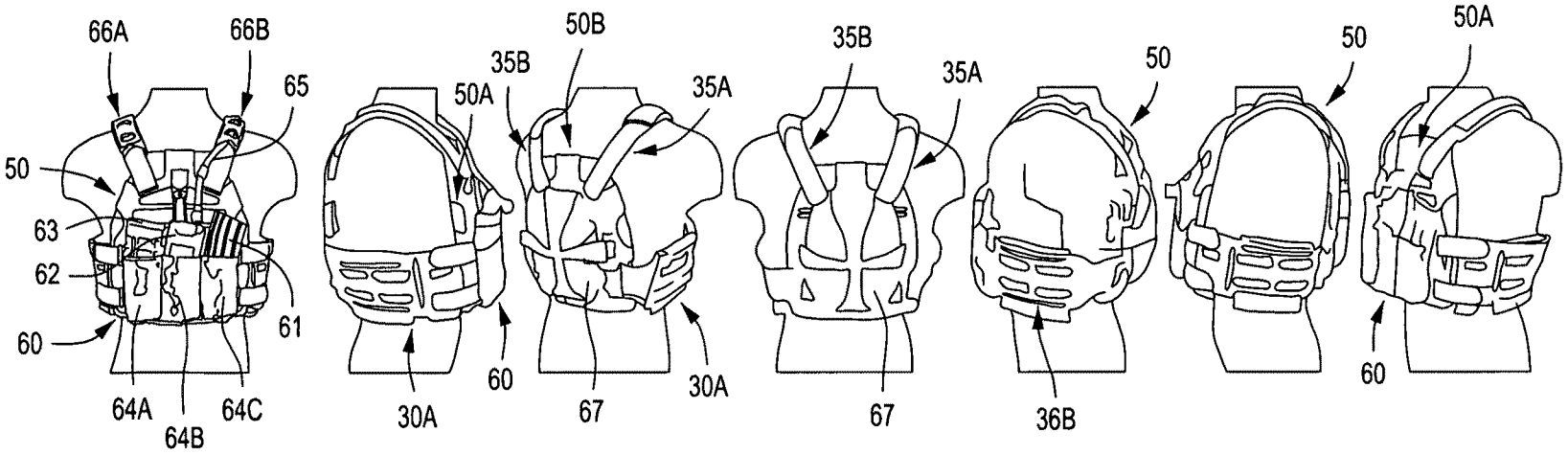
FIG. 8 shows multiple views of accessories attached to a plate frame assembly worn on a user's torso in embodiments.

These holes 6A, 6B, 7A, 7B may be used for threading attachment straps 35A, 35B therethrough to support the plate frame 10 and any other connections to the plate frame 10 (body armor plate 20, other attachment straps, and/or any equipment attached to the plate frame) on the shoulders of a user's body (see FIGS. 7 and 8). These holes 6A, 6B, 7A, 7B in some embodiments are sufficient in length and width to allow the attachment straps 35A, 35B to thread therethrough as shown in FIGS. 6-8. The holes 6A, 6B, 7A, 7B in some embodiments may either be generally rectangular or oblong or oval shaped, for example as shown in FIGS. 1-2. The width or smaller diameter of the holes 6A, 6B, 7A, 7B as measured at their central axes should be larger than the thickness of the attachment straps 35A, 35B, and the length or larger diameter of the holes 6A, 6B, 7A, 7B as measured at their central axes should be larger than the width of the attachment straps 35A, 35B to ensure that the attachment straps 35A, 35B may be inserted therethrough. In one example, the attachment straps 35A, 35B may each be approximately 1.5 inches wide, and the holes 6A, 6B, 7A, 7B may correspond to those dimensions to provide a loose fit in order to allow the attachment straps 35A, 35B to slip through the holes easily. In some embodiments, the holes are slanted on the plate frame 10, to generally correspond with the sloping of a user's shoulders so that the shoulder attachment straps 35A, 35B ultimately may slant downward.

The first plate frame portion 10A may also include one or more cummerbund strap attachment holes, including in some embodiments first cummerbund strap attachment hole 8A and second cummerbund strap attachment hole 8B spaced apart from one another on a first side of the first plate frame portion 10A and third cummerbund strap attachment hole 8C and fourth cummerbund strap attachment hole 8D spaced apart from one another on a second side of the first plate frame portion 10A. The second plate frame portion 10B may also include one or more cummerbund strap attachment holes, including in some embodiments fifth cummerbund strap attachment hole 9A on one side and sixth cummerbund strap attachment hole 9B on the other side of the second plate frame portion. Embodiments are not limited to the number of holes on each side of the plate frame portions 10A, 10B, but any number of holes through the plate frame portions 10A, 10B which allow threading of cummerbund attachments straps 30A and 30B or other similar attachment straps therethrough are within the scope of embodiments (likewise, any number of holes through the plate frame portions 10A, 10B which allow threading of the shoulder attachment straps 35A, 35B therethrough is also within the scope of embodiments). In some embodiments, the first and second holes 8A and 8B may be instead just one continuous hole, and the third and fourth holes 8C and 8D may instead be just one continuous hole similar to the holes 9A, 9B. In some embodiments, the holes 9A and 9B may be split up into two holes on each side, similar to the holes 8A, 8B and 8C, 8D.

The holes 8A, 8B, 8C, 8D, 9A, and 9B may be positioned at or near a waist area of a user when the user has the plate frame 10 disposed on his or her body properly to support and position the plate frame 10 and any other connections to the plate frame 10 (body armor plate 20, other attachment straps, and/or any equipment attached to the plate frame) with respect to a waist area of a user's body (see FIGS. 7 and 8).

In some embodiments, when the inside of the first plate frame portion 10A and the inside of the second plate frame portion 10B are facing one another, the first and second cummerbund strap attachment holes 8A and 8B and the first cummerbund strap attachment hole 9A correspond to one another and are generally in line with one another, and the third and fourth cummerbund strap attachment holes 8C and 8D and the second cummerbund strap attachment hole 9B correspond to one another and are generally in line with one another. These holes 8A, 8B, 8C, 8D, 9A, and 9B in some embodiments are sufficient in length and width to allow the attachment straps 30A, 30B to thread therethrough as shown in FIGS. 6-8. The holes 8A, 8B, 8C, 8D, 9A, and 9B in some embodiments may either be generally rectangular or oblong or oval shaped, for example as shown in FIGS. 1-2. The width or smaller diameter of the holes 8A, 8B, 8C, 8D, 9A, and 9B as measured at their central axes should be larger than the thickness of the attachment straps 30A, 30B being threaded through the particular hole, and the length or larger diameter of the holes 8A, 8B, 8C, 8D, 9A, and 9B as measured at their central axes should be larger than the width of the attachment straps 30A, 30B portion being threaded through the particular hole to ensure that the attachment straps 30A, 30B may be inserted therethrough. Example dimensions (which are not limiting of embodiments) include the following: the width W3 may be approximately 1.250 inches, and the width W1 may be approximately 2.750 inches.

Attachment Straps and Accessories (see FIGS. 5-8)

FIG. 5 shows the attachment straps 35A and 35B as well as the attachment straps 30A and 30B, and FIGS. 6-8 illustrate an embodiment of the plate frame 10 with the attachment straps disposed through their respective holes in the plate frame 10. The attachment straps 35A and 35B may each be a generally flexible band or strap having a length, width, and thickness. In some examples which are not limiting of embodiments, each of the straps 35A, 35B may be approximately 1.5 inches wide and approximately 24 inches long.

In an embodiment, the attachment straps 30A and 30B may each include a first end 31 and a second end 32. A first attachment strap portion 33A extending from the first end 31 to a first location on the attachment strap 30A, 30B may be of a first width W1 and may be single attachment strap as shown in FIG. 5. A second attachment strap portion 33B may be of a second width W2 and also a single attachment strap as shown in FIG. 5. A third attachment strap portion 33C may include two straps 34A, 34B spaced apart from one another, each strap having a width W3. The two straps 34A, 34B may extend to the second end 32.

In some embodiments, between the second attachment strap portion 33B and the first attachment strap portion 33A, the width may taper gradually, in one example at an angle of approximately 45 degrees. In one example embodiment which is shown in FIG. 5, the first width W1 is smaller than the second width W2, and the third width W3 may be smaller than the first width W1. In some embodiments, the combined width of the third width W3 of both straps 34A, 34B as well as the space between the two straps 34A, 34B may be approximately the same as the width W2. In an example which is not limiting of embodiments, the width W1 may be approximately 2.75 inches, the width W2 may be approximately 5 inches, the width W3 may be approximately 1.25 inches, the space between straps 34A and 34B may be approximately 2 inches, the length of first attachment strap portion 33A may be approximately 11.5 inches, the length of second attachment strap portion 33B may be approximately 11 inches, and the length of third attachment strap portion 33C may be approximately 5 inches.

The first portion 31 may be sized to fit through the holes 9A, 9B through the second plate frame portion 10B, and the third portion 33C straps 32 may be sized so that each of the two straps 32 may fit through the holes 8A, 8B, 8C, and 8D through the first plate frame portion 10A. Additionally, the space S between the two straps 32 is sized so that the straps 32 may fit through the holes 8A and 8B or 8C and 8D (in other words, the space S—or the distance between the straps 32—generally corresponds with the distance of the holes 8A and 8B from one another or the distance of the holes 8C and 8D from one another. The different widths W1 and W2 of the attachment straps 30A and 30B may act as a stop at the width W2 for the attachment straps 30A and 30B through their respective holes in the plate frame 10. The portion of the width W2 between the space S may also act as a stop for the other end of the attachment straps 30A, 30B through their respective holes in the plate frame 10.

The second portion 33B of each attachment strap 30A, 30B may include one or more holes therethrough which allow attaching of tactical equipment or other accessories to one or more of the attachment straps 30A, 30B. In the embodiment shown in FIG. 5, the one or more holes include four holes 36A, 36B, 36C, and 36D, with two in the first row (holes 36A and 36B) and two in the second row (holes 36C and 36D). Of course, any number of holes in any configuration may be included on the attachment straps 30A, 30B and may be included on any portion of the attachment straps 30A, 30B to permit attachment of tactical equipment or other accessories to the attachment straps 30A, 30B.

The first, second, and third portions 33A, 33B, 33C may be made of one unitary piece or may be attached or fused to one another, e.g., via welding when made of a weldable material. Other attachment methods known to those skilled in the art for attaching strap portions or other similar materials to one another are also within the scope of embodiments.

The material used to make the one or more shoulder attachment straps 35A, 35B, the one or more cummerbund attachment straps 30A, 30B, and any other accessories or attachments (see FIG. 8 and description below) for the plate frame 10 could, for example, be a non porous, liquid and chemical resistant fabric. The one or more attachment straps 30A, 30B, 35A, 35B and any accessories or attachments could, for example, be formed and fused out of weldable material to alleviate any machine or hand sewing. By making the one or more attachment straps 30A, 30B, 35A, 35B and accessories or attachments out of these types of materials, embodiments are liquid, chemical, and biohazard resistant. By welding the materials together instead of sewing, you eliminate the sewn seems where bio-contaminants and chemicals can easily get trapped, thus making embodiments more easily decontaminated. Forming the one or more attachment straps 30A, 30B, 35A, 35B and any accessories or attachments out of these types of materials also eliminates any extra weight being added to the material when the plate frame 10 and associated components are submerged in water.

Figure 4:
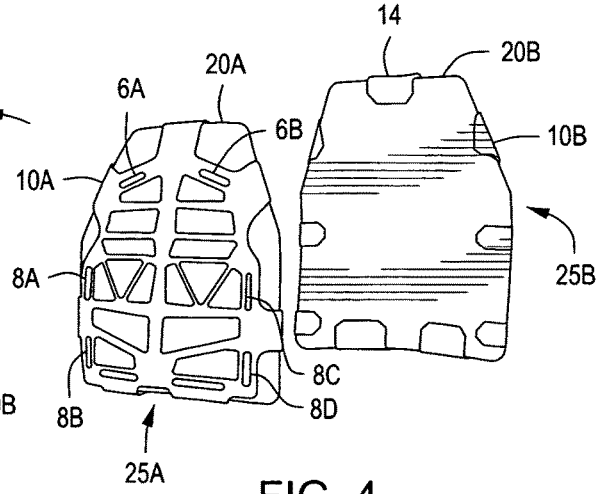
FIG. 4 is a perspective view of a body armor plate in a plate frame of embodiments.

To attach the plate frame 10 to the body plate 20, each body armor plate portion 20A, 20B is placed in its respective plate frame portion 10A, 10B, and the one or more tabs 12, 14 of the plate frame portions 10A, 10B clamp around the outer edges of the body armor plate portions 20A, 20B to retain each body armor plate portion 20A, 20B with (and in some embodiments, within) its corresponding plate frame portion 10A, 10B. Each body armor plate section 20A, 20B may be at least partially housed within its respective plate frame portion 10A, 10B. The tabs 12, 14 may bend back to allow each body plate portion 20A, 20B to be inserted in the tabs 12, 14 of its respective plate frame portion 10A, 10B and housed between the tabs 12, 14 and the inside of the plate frame portion 10A, 10B so that the tabs 12, 14, which may also be termed "hooks," may hook each body plate portion 20A, 20B to its respective plate frame portion 10A, 10B or may wrap around each body plate portion 20A, 20B to connect the body plate portions 20A, 20B to their respective plate frame portions 10A, 10B. FIG. 4 shows the body plate 20 attached (e.g., hooked or clamped) to the plate frame 10 via extensions or tabs 12, 14. The tabs 12, 14 may be spaced apart along the outer perimeter of the plate frame 10 to distribute the attachment points along the plate frame 10 and body plate 20, thus more securely attaching the components to one another and distributing the force exerted on the plate frame 10 and body plate 20 along the components.

When the body plate 20 and plate frame 10 are attached to one another, for example as shown in FIG. 4, the body plate 20 provides the ballistic protection, while the plate frame 10 holds the body plate 20 in general position on the user's body and allows the attachment of accessories and tactical equipment to the plate frame 10 and body plate 20. The holes in the plate frame 10 allow attachment of one or more accessories and/or tactical equipment to the assembly of the body plate 20 and plate frame 10, while the body plate 20 provides ballistic protection at the locations of the plate frame 10 holes.

The plate frame assembly 50 includes the shoulder attachment straps 35A, 35B, the plate frame 10, and the body armor plate 20. When the shoulder attachment straps 35A and 35B are threaded through their respective holes 6A, 7A and 6B, 7B in the plate frame 10 and the cummerbund attachment straps 30A and 30B are threaded through their respective holes 8A, 8B, 9A and 8C, 8D, and 9B, the plate frame assembly 50 may be used as protection for the user as shown in FIG. 7.

Figure 9A:
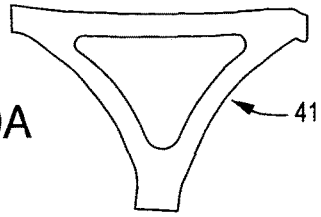
FIG. 9A is a section view of a bladder of embodiments.

Inflatable and/or Non-Inflatable Bladders (see FIGS. 9A-10)

Figure 9B:
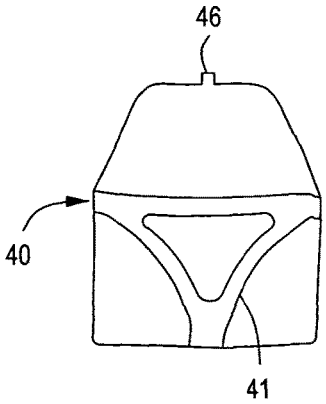
FIG. 9B is a front view of a first embodiment of a bladder which may be used with the plate frame assembly of embodiments.
Figure 9C:
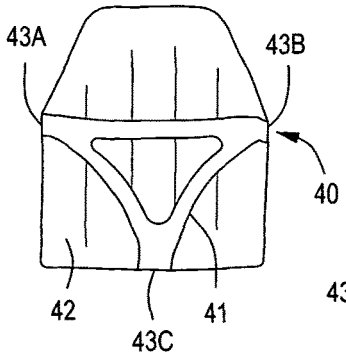
FIG. 9C is a front view of a first embodiment of a bladder which may be used with the plate frame assembly of embodiments.
Figure 9D:
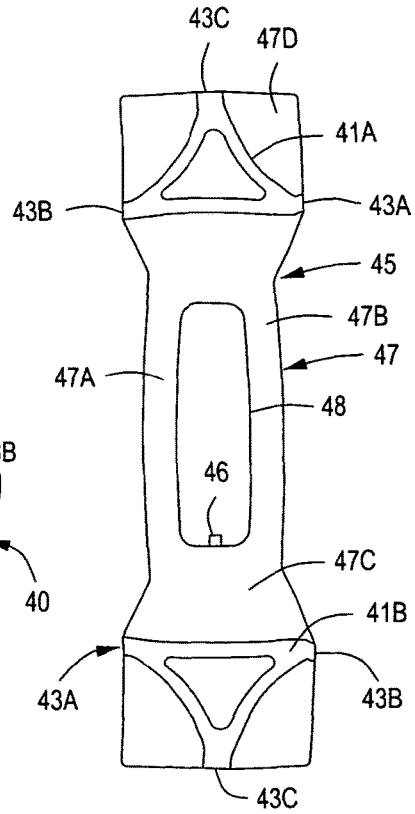
FIG. 9D shows to view of a second embodiment of a bladder which may be used with the plate frame assembly of embodiments.

The plate frame assembly 50, which could be a rigid plate frame assembly, may optionally include one or more inflatable or non-inflatable bladders or other similar padding devices or padding members known to those skilled in the art. FIGS. 9B and 9C show an exemplary bladder 40 which may be used as padding for the plate frame assembly 50, FIG. 9A shows a strap or a first section 41 which may be included with the bladder 40 of FIG. 9B, and FIG. 9D shows a second embodiment of a bladder 45 which may be used as padding for the plate frame assembly 50.

Figure 10A:
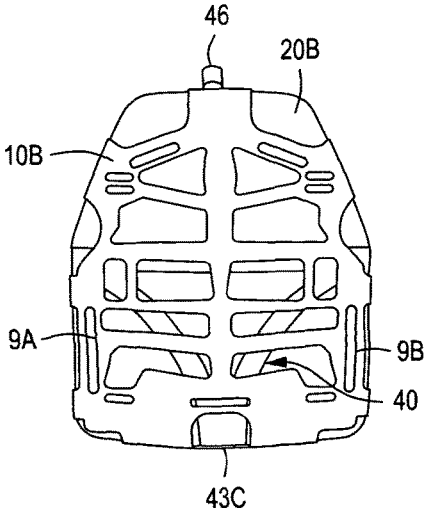
FIG. 10A is a front view of an embodiment of an inflatable bladder attached to a plate frame with a body armor plate.
Figure 10B:
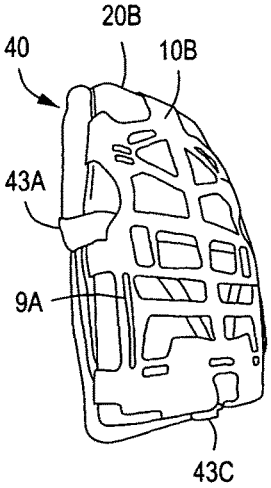
FIG. 10B is a perspective view of the bladder attached to the plate frame with a body armor plate of FIG. 10A.
Figure 10C:
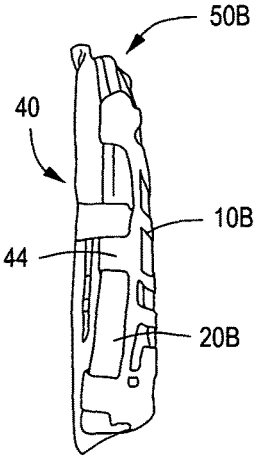
FIG. 10C is a side perspective view of the bladder attached to the plate frame with a body armor plate of FIG. 10A.

In some embodiments, the bladder 40 may include a first section 41 and a second section 42. The first section 41 may be used to secure the bladder 40 to the plate frame 10 and body plate 20 and may be a strap for strapping the bladder 40 to the body plate 20. One bladder 40 may be used in conjunction with the first plate frame portion 10A and first body armor plate portion 20A assembly 50A, and another bladder 40 may be used in conjunction with the second plate frame portion 10B and second body armor plate portion 20B assembly 50B. FIGS. 10A, 10B, and 10C show the bladder 40 connected to the second plate frame portion 10B and second body plate portion 20B, with the second plate frame portion 10B and second body armor plate portion 20B attached to one another. To assemble the bladder 40 into the second plate frame portion assembly 50B, the second body plate portion 20B and the bladder 40 may be manipulated so that the second body armor plate portion 20B is disposed between the first section 41 and second section 42 of the bladder 40.

The first section 41 and second section 42 of the bladder 40 may be attached to one another at connection points 43A, 43B, and 43C, the connection points acting as stops for the bladder 40 with respect to the second plate frame assembly 50B. When the second body plate frame 20B is disposed in the bladder 40 between the first and second sections 41, 42, the connection point 43C keeps the bladder 40 in vertical position to prevent its riding up on second plate frame assembly 50B, and the connection points 43A and 43B keep it in horizontal position to prevent its moving horizontally with respect to the second plate frame assembly 50B. Additionally, the connection points 43A and 43B may rest on a tab portion 44 (e.g., one of the tabs 14) of the second plate frame portion to keep the bladder 40 in a vertical position to prevent its downward movement with respect to the second plate frame assembly 50B. Of course, the connection points 43A, 43B, 43C may result from the first section 41 and second section 42 being attached to one another, or instead the entire bladder may be made from one unitary piece of material so that connection points 43A, 43B, 43C are actually stops for the bladder 40 with respect to the second plate frame assembly 50B but not connection points between two pieces of material.

The first section 41 of the bladder 40, which may be a strap, may be generally triangular-shaped to allow for triangulating stops for the bladder 40 with respect to the body plate 20. In some embodiments, the first section 41 may also include a triangular-shaped cutout therein. The second section 42 of the bladder 40 may be shaped generally the same as the body armor plate portions 20A, 20B (with respect to the perimeter of the body plate portions 20A, 20B) to provide padding for the entire portion of the body plate 20 facing the user's body, which body plate 20 portion would be in contact with the user's body without presence of the bladder 40. In some embodiments, the contour and curvature of the bladder 40 also generally conform to the contour and curvature of the body plate 20.

These bladder(s) 40 may be padded internally with foam and/or air (and/or other similar internal padding substance known to those skilled in the art), e.g., with the second section 42 acting as the housing for the foam or other padding or as an air chamber. When the bladder is padded internally with air or other fluid, the bladder 40 may include one or more valves 46 which allow air or other fluid to enter and/or exit the inside of the bladder 40 to increase or decrease padding for the user. The padding may be adjustable (e.g., by adding or removing air from the inside of the bladder through valve(s)) to increase or decrease padding to the user as needed or desired.

A separate bladder 40 may be placed on each plate frame assembly portion 50A and 50B to protect the front and back of the user, respectively. The bladder 40 configuration and operation may be the same when used in conjunction with the plate frame assembly portion 50A as described herein with respect to the plate frame assembly portion 50B.

FIG. 9D illustrates a second embodiment of a bladder 45 for use with the plate frame assembly 50 of embodiments. This bladder 45 may be used to provide padding for both the front and back of the user between the body plate portions 20A, 20B and the user's body. The bladder 45 may include a first section 41A at one end and a first section 41B at the other end of the bladder 45, the sections 41A and 41B the same in configuration and operation as the first section 41 described with respect to the bladder 40. The bladder 45 may also include a second section 47 connected to each first section 41A, 41B at the three triangular attachment points 43A, 43B, 43C as described with respect to the second section 42 of the bladder 40. Just as described with respect to the bladder 40, the first sections 41A, 41B and second section 47 may instead of being two separated, connected pieces be made of one unitary piece of material, and the connection points 43A, 43B, 43C may instead just function as stops.

The second section 47 of the bladder 45 may include one piece that extends over the shoulders of the user and over the front and back of the user's torso. In this way, the bladder 45 may also pad the shoulders of the user, in addition to padding the front and back of the user's torso between the body armor plate 20 and the user's body. The second section 47 of the bladder 45 may include a first portion 47C and second portion 47D, the first and second portions each similar in shape and configuration to the second section 42 of the bladder 40. Extending between the first and second portions 47C and 47D is a third portion which includes shoulder padding portions 47A and 47B. The shoulder padding portions 47A and 47B are formed by a cutout 48 through the bladder 47. The cutout 48 allows a person's head to be inserted therethrough so that the shoulder padding portions 47A and 47B rest on the person's shoulders between the shoulder attachment straps 35A, 35B and the user's shoulders. In an alternate embodiment, the shoulder padding portions 47A and 47B may act as the shoulder attachment straps, possibly eliminating the need for the shoulder attachment straps 35A, 35B.

The bladder 45 may include one or more valves 46 for adding and removing air or other fluid from the bladder 45 to increase or decrease padding of the bladder 45, as described with respect to the bladder 40. The bladder 45 may be added to the plate frame assembly 50 in much the same way as the bladder 40 may be added to the plate frame assembly, except that one of the portions 47C or 47D is used to pad the body plate portion 20A and the other of the portions 47C or 47D is used to pad the body plate portion 20B, with the shoulder padding portions 47A and 47B over the right and left shoulders of the user. The bladder portion 47C may be secured to the first plate frame assembly 50A by the first section 41A being sandwiched between the plate frame portion 10A and the body plate portion 20A and the bladder portion 47C disposed between the body plate portion 20A and the user's body. The bladder portion 47D may be secured to the plate frame assembly portion 50B by the first section 41B being sandwiched between the plate frame portion 10B and the body plate portion 20B and the bladder portion 47D disposed between the body plate portion 20A and the user's body. Of course, it is within the scope of embodiments that the either of the first sections 47C, 47D may be used in either the plate frame assembly portion 50A or the plate frame assembly portion 50B. The bladder 47, including bladder portions 47A, 47B, 47C, and 47D, in one embodiment may act as one single housing for the foam or other padding or act as a single air chamber.

The valve(s) 46 for the bladder(s) 40, 45 are optional. To inflate or increase padding of the bladder 40, 45, an air or fluid source such as an air pump may be hooked up to the valve, and air may be pumped into the inside of the bladder 40, 45 through the valve 46 to the desired inflate level. To deflate or decrease padding of the bladder 40, 45, the valve may be opened to let air/fluid out of the inside of the bladder 40, 45.

The bladder(s) 40, 45 may be sealed and made of a non-porous material. This bladder 40, 45 provides a pad between the rigid armor frame and the user's body to provide comfort. The air trapped in the bladder 40, 45 also helps float the armor should it become submerged in water. The bladder 40, 45 may be made of a non-porous material that is liquid, chemical and biohazard resistant. The bladder material may, for example, be made of any material meeting these requirements which is used for inflatable or non-inflatable bladders by those skilled in the art. These types of material can be easily decontaminated. Making the bladder(s) 40, 45 of this type of material also eliminates any extra weight being added to the material and thus to the plate frame assembly 50 when the plate frame assembly 50 is submerged in water.

In embodiments described herein, the one or more attachment straps 30A, 30B, 35A, 35B, the one or more bladders 40, 45, and the one or more accessory pouches or other accessories may, for example, be made of a polyvinyl chloride ("PVC") coated nylon, a vinyl-coated polyester or cordura or ripstop fabric, a two-way or four-way stretch nylon and Spandex blend, and/or a polyester mesh. These materials are merely example materials and not limiting of the materials from which these components may be made. The material used to make the one or more attachment straps 30A, 30B, 35A, 35B, the one or more bladders 40, 45, and the one or more accessory pouches or other accessories could, for example, be a non porous, liquid and chemical resistant fabric. These components could, for example, be formed and fused out of weldable material to alleviate any machine or hand sewing. By making these components out of these types of materials, embodiments are liquid, chemical, and biohazard resistant. By welding the materials together instead of sewing, you eliminate the sewn seams where bio-contaminants and chemicals can easily get trapped, thus making embodiments more easily decontaminated. Forming these components out of these types of materials also eliminates any extra weight being added to the material when the plate frame 10 and associated components are submerged in water.

FIG. 8 shows various accessories or attachments attached to the plate frame assembly 50 or plate carrier assembly. The attachment may include pouches or pockets 64A, 64B, 64C. Any number of pouches or pockets may be attached to the plate frame assembly 50, including one or more than one pouch or pocket. The attachment may, for example, be an ammunition of magazine pouch 60 having three pockets or pouches 64A, 64B, 64C for holding one or more accessories such as magazine 63, magazine 62, and/or magazine 61 (carry bullets/ammunition). The attachment may be attached to the front plate frame assembly portion 50A, as shown in FIG. 8. One or more accessories or attachments may also be attached to the back plate frame assembly portion 50B, such as a backpack 67 or pouch for carrying water or other fluid. The one or more attachments or accessories may be connected to the plate carrier 10 by attachment of the one or more attachments or accessories or straps extending therefrom to one or more attachment straps 35A, 35B which are thread through holes in the plate frame 10, through threading straps extending from the one or more attachments or accessories through one or more holes in the plate frame, and/or through snapping a portion of the attachments or accessories (e.g., an extension from the attachment or accessories) into one or more of the holes through the plate frame 10. The one or more attachments or accessories, while securely fastened to the plate frame 10, may also be easily removed from the plate frame 10.

A method of forming the plate frame assembly 50 or plate carrier assembly includes attaching the plate frame 10 and body plate 20 to one another. To attach the plate frame 10 and body plate 20 to one another, the first plate frame portion 10A and the first body plate portion 20A are connected to one another, and the second plate frame portion 10B and the second body plate portion 20B are connected to one another. To attach the first plate frame portion 10A to the first body plate portion 20A, the first body plate portion 20A is placed in the inward curve of the first plate frame portion 10A via movement of the extensions 12 or tabs extending from the first plate frame portion 10, the extensions 12 or tabs moving in a direction away from the first plate frame portion 10A via applied force to allow the first body plate portion 20A to be housed at least partially within the inward curve of the inside of the first plate frame portion 10A. The extensions 12 or tabs move in a direction toward the first plate frame portion 10A upon the absence of the application of force (e.g., they are biased closed) to retain the first body armor plate portion 20A in place with respect to the first plate frame portion 10A when the first body plate portion 20A is in place, housed in the first plate frame portion 10A. The extensions 12 or tabs may also clamp the first body plate portion 20A in place with respect to the first plate frame portion. The second body plate portion 20B is connected to the second plate frame portion 10B in the same manner as described herein with respect to the first body plate portion 20A and the first plate frame portion 10A, with extensions 14 or tabs being used instead of extensions 12 or tabs. FIG. 4 shows the first body plate portion 20A connected to the first plate frame portion 10A as well as the second body plate portion 20B connected to the second plate frame portion 10B.

The shoulder attachment strap 35A is disposed through the hole 6A in the first plate frame portion 10A and through the hole 7A in the second plate frame portion 10B so that a first end of the shoulder attachment strap 35A extends through the first hole 6A and a second end of the shoulder attachment strap 35A extends through the second hole 7A. The shoulder strap 35A portions which extend from the holes 6A, 7A may then be attached to the shoulder strap portion which they overlap (the strap may be attached to itself) (see FIG. 6), e.g., via welding, fusing, or attaching hook and loop fasteners secured to the shoulder attachment strap 35A by welding or fusing, to secure the shoulder attachment strap 35A to the first plate frame portion 10A and second plate frame portion 10B, thereby attaching the first and second plate frame portions 10A and 10B to one another and providing a shoulder strap for the user which secures the plate frame assembly 50 to the user's body (e.g., via hanging from the user's shoulder). The shoulder attachment strap 35A may in one embodiment have one or more hook and loop fasteners (e.g., Velcro®) welded or fused to the shoulder attachment strap 35A to allow attaching the shoulder attachment strap 35A at or near its ends to the overlapping portions of the shoulder attachment strap 35A via placing cooperating hook and loop fasteners in contact with one another as known to those skilled in the art (attach the attachment strap 35A back onto itself). In another embodiment, the shoulder attachment strap 35A may be welded or fused at or near its ends to the overlapping portions of the shoulder attachment strap 35A (welded or fused onto itself).

The shoulder attachment strap 35B is disposed through the hole 6B in the first plate frame portion 10A and through the hole 7B in the second plate frame portion 10B so that a first end of the shoulder attachment strap 35B extends through the first hole 6B and a second end of the shoulder attachment strap 35B extends through the second hole 7B. The shoulder strap 35B portions which extend from the holes 6B, 7B may then be attached to the shoulder strap portion which they overlap (the strap may be attached to itself) (see FIG. 6), e.g., via welding, fusing, or attaching hook and loop fasteners secured to the shoulder attachment strap 35B by welding or fusing, to secure the shoulder attachment strap 35B to the first plate frame portion 10A and second plate frame portion 10B, thereby attaching the first and second plate frame portions 10A and 10B to one another and providing a second shoulder strap for the user which secures the plate frame assembly 50 to the user's body (e.g., via hanging from the user's shoulder). The shoulder attachment strap 35B may in one embodiment be welded or fused at or near its ends to the overlapping portions of the shoulder attachment strap 35B (welded or fused onto itself). In another embodiment, the shoulder attachment strap 35B may have one or more hook and loop fasteners (e.g., Velcro®) welded or fused to the shoulder attachment strap 35B to allow attaching the shoulder attachment strap 35B at or near its ends to the overlapping portions of the shoulder attachment strap 35B via placing cooperating hook and loop fasteners in contact with one another as known to those skilled in the art (attach the attachment strap 35B back onto itself).

The cummerbund attachment strap 30A is disposed through the holes 8A and 8B in the first plate frame portion 10A and through the hole 9A in the second plate frame portion 10B so that first ends 32 of the cummerbund attachment strap 30A extend through the first holes 8A and 8B and the second end 31 of the cummerbund attachment strap 30A extends through the second hole 9A. The cummerbund attachment strap 30A portions which extend from the holes 8A and 8B may then be attached to the cummerbund strap portion which they overlap (the strap may be attached to itself) (see FIG. 6), e.g., via welding, fusing, or attaching hook and loop fasteners secured to the cummerbund attachment strap 30A by welding or fusing, to secure the cummerbund attachment strap 30A to the first plate frame portion 10A and second plate frame portion 10B, thereby attaching the first and second plate frame portions 10A and 10B to one another and providing a cummerbund for the user which secures the plate frame assembly 50 to the user's body (e.g., via extending around the user's waist area). The cummerbund attachment strap 30A may in one embodiment be welded or fused at or near its ends 31, 32 to the overlapping portions of the cummerbund attachment strap 30A (welded or fused onto itself). In another embodiment, the cummerbund attachment strap 30A may have one or more hook and loop fasteners (e.g., Velcro®) welded or fused to the cummerbund attachment strap 30A to allow attaching the cummerbund attachment strap 30A at or near its ends to the overlapping portions of the cummerbund attachment strap 30A via placing cooperating hook and loop fasteners in contact with one another as known to those skilled in the art (attach the attachment strap 30A back onto itself).

The cummerbund attachment strap 30B is disposed through the holes 8C and 8D in the first plate frame portion 10A and through the hole 9B in the second plate frame portion 10B so that first ends 32 of the cummerbund attachment strap 30B extend through the first holes 8C and 8D and the second end 31 of the cummerbund attachment strap 30A extends through the second hole 9B. The cummerbund attachment strap 30B portions which extend from the holes 8C and 8D may then be attached to the cummerbund strap portion which they overlap (the strap may be attached to itself) (see FIG. 6), e.g., via welding, fusing, or attaching hook and loop fasteners secured to the cummerbund attachment strap 30B by welding, to secure the cummerbund attachment strap 30B to the first plate frame portion 10A and second plate frame portion 10B, thereby attaching the first and second plate frame portions 10A and 10B to one another and providing a cummerbund for the user which secures the plate frame assembly 50 to the user's body (e.g., via extending around the user's waist area). The cummerbund attachment strap 30B may in one embodiment be welded or fused at or near its ends 31, 32 to the overlapping portions of the cummerbund attachment strap 30B (welded onto itself). In another embodiment, the cummerbund attachment strap 30B may have one or more hook and loop fasteners (e.g., Velcro®) welded or fused to the cummerbund attachment strap 30B to allow attaching the cummerbund attachment strap 30B at or near its ends to the overlapping portions of the cummerbund attachment strap 30B via placing cooperating hook and loop fasteners in contact with one another as known to those skilled in the art (attach the attachment strap 30B back onto itself).

It is within the scope of embodiments that the attachment straps 30A, 30B, 35A, 35B may be threaded through any holes in the plate frame portions 10A, 10B and that the attachment straps 30A, 30B, 35A, 35B may be connected to the plate frame portions 10A, 10B using any attachment method known to those skilled in the art. Embodiments also are not limited to attaching the attachment straps 30A, 30B, 35A, 35B to their overlapping portions at the ends of the straps 30A, 30B, 35A, 35B, but the attachment (e.g., by welding, by fusing, or by connecting cooperating hook and loop fasteners secured to the attachment strap 30A, 30B, 35A, 35B by welding or fusing) may be accomplished at any overlapping portions of the straps 30A, 30B, 35A, 35B when the straps 30A, 30B, 35A, 35B are inserted through their respective holes in the plate frame 10.

When the one or more bladders 40 are used with the plate frame assembly 50, a bladder 40 may be disposed on the first body plate portion 20A so that the first body plate portion 20A is located between the first section 41 and second section 42 of the bladder 40, as shown in FIGS. 10A, 10B, and 10C. Thus, the first body plate portion 20A is sandwiched between the first section 41 and second section 42 of the bladder 40, and the attachment point 43C of the bladder 40 acts as a stop for the bladder 40. The first plate frame portion 10A may then be "snapped" on the first body plate portion 20A as described herein, and the first section 41 of the bladder 40, which acts as a strap to secure the bladder 40 to the first body plate portion 20A, is housed between the first body plate portion 20A and the first plate frame portion 10A as shown in FIGS. 10A-C. The second section 42 of the bladder 40 is located on the inside surface of the first body armor plate 20A, as shown in FIGS. 10A-C, to provide padding between the user's body and the first body armor plate 20A. Also as shown in FIGS. 10A-C, the first and second attachment points 43A and 43B may rest on one of the extensions/tabs 12 of the first plate frame portion 10A to stabilize the position of the bladder 40 with respect to the first plate frame assembly.

Another bladder 40 may be disposed on the second body plate portion 20B so that the second body plate portion 20B is located between the first section 41 and second section 42 of the bladder 40, as shown in FIGS. 10A-C. Thus, the second body plate portion 20B is sandwiched between the first section 41 and second section 42 of the bladder 40, and the attachment point 43C of the bladder 40 acts as a stop for the bladder 40. The second plate frame portion 10B may then be "snapped" on the second body plate portion 20B as described herein, and the first section 41 of the bladder 40, which acts as a strap to secure the bladder 40 to the second body plate portion 20B, is housed between the second body plate portion 20B and the second plate frame portion 10B as shown in FIGS. 10A-C. The second section 42 of the bladder 40 is located on the inside surface of the second body armor plate portion 20B, as shown in FIGS. 10A-C, to provide padding between the user's body and the second body armor plate portion 20B. Also as shown in FIG. 10A-C, the first and second attachment points 43A and 43B may rest on one of the extensions/tabs 14 of the second plate frame portion 10B to stabilize the position of the bladder 40 with respect to the second plate frame assembly.

When the bladder 45 is used with the plate frame assembly 50 or plate carrier assembly, the first body plate portion 20A is inserted in between the sections of one end of the bladder 45, and the second body plate portion 20B is inserted in between the sections of the other end of the bladder 45. For example, the first body plate portion 20A is inserted between the section 41A and the section 47D, while the second body plate portion 20B is inserted between the section 41B and the section 47C. The body plate portions 20A and 20B are ultimately housed between the bladder portion 47 and the bladder portions 41A and 41B, respectively. The body plate portion 20A is sandwiched between the bladder sections 41A and 47D, while the body plate portion 20B is sandwiched between the bladder sections 42A and 47C. The attachment points 43A, 43B, and 43C act as stops for the bladder 45 ends. The plate frame portions 10A, 10B which correspond with the body armor plate portions 20A, 20B may then be "snapped" onto the body armor plate portions 20A, 20B as described herein. The shoulder straps 35A, 35B and the cummerbund straps 30A, 30B may then be attached to the plate frame 10 as described herein.

It is also within the scope of embodiments that the attachment straps 30A, 30B, 35A, 35B may be attached to the plate frame 10 at any point in the method, including prior to the attachment of the body plate 20 to the plate frame 10 and/or bladder(s) 40, 45 to the plate frame assembly 50.

The plate frame assembly 50 may be worn on the user as shown in FIG. 7. FIG. 7 shows the plate frame assembly 50 worn without the bladders 40, 45, but the plate frame assembly 50 with the bladders 40, 45 would be worn in much the same way. The plate frame assembly 50 may be placed over the head of the user after it is assembled, or a portion of the plate frame assembly 50 (e.g., the two plate frame assembly portions 50A, 50B) may be placed on the user during the assembly of the plate frame assembly 50 (e.g., prior to the adding of the shoulder straps 35A, 35B and/or cummerbund straps 30A, 30B to the plate frame assembly portions 50A, 50B).

If the bladders 40, 45 are inflatable, they may be inflated at any time during the method, or air or other inflating substance may be added or removed at any point in the method, and they may also be inflated or the inflating substance added or removed when the user is wearing the plate frame assembly 50. The bladders 40, 45 may optionally be attached to the cummerbund attachment straps 30A, 30B.

The cummerbund attachment straps 30A, 30B are not limited to being worn around the waist area or typical cummerbund coverage area of the user, but may be worn around the user at any location.

The shoulder support straps 35A, 35B are merely examples of a shoulder supporting member for the plate frame assembly. Instead of the shoulder support straps 35A, 35B, any type of shoulder supporting member which allows the plate frame assembly 50 to be supported by the shoulders of a user may be utilized with the plate frame assembly 50, and the shoulder supporting member is not limited to straps.

A second embodiment of a plate frame assembly 150 is shown in FIGS. 11-17. The plate frame assembly 150 may include first and second plate frame portions 110A and 110B and first and second body armor portions 120A and 120B, the first plate frame portion 110A for retaining the first body armor portion 120A and the second plate frame portion 110A for retaining the second body armor portion 120B. The first plate frame portion 110A may at least partially house the first body armor portion 120A therein, and the second plate frame portion 110B may at least partially house the second body armor portion 120B therein. The plate frame assembly 150 is very similar in function and operation to the plate frame assembly 50 shown and described in relation to FIGS. 1-10, with the primary difference in function and operation being in the extensions/tabs (or hooks or clamps) which retain the body armor portions 120A, 120B in position with respect to their respective plate frame portions 110A, 110B. The tabs of the embodiment of FIGS. 11-17 may be adjustable and/or interchangeable tabs 11 2A-G and 11 4A-G.

The adjustable tabs 112A-G and 114A-G may be adjustable to fit body armor plates of various widths, lengths, and thicknesses. The tabs 112A-G and 114A-G may be insertable in corresponding holes in the plate frame portions 110A and 110B, respectively. Holes in the plate frame portions 110A, 110B through which the tabs 112A-G, 114A-G are insertable may be raised portions (e.g., raised portion 191 shown in FIG. 15) of the plate frame portions 110A, 110B with holes (e.g., hole 180 shown in FIG. 15) therethrough corresponding to the shape of the tabs 112A-G and 114A-G to be inserted therein (in alternate embodiments, the raised portions 191 may instead be separate pieces attached to the plate frame portions 110A, 110B). The tabs 112A-G and 114A-G may be swapped out for tabs of different sizes to fit different sizes of body armor plates 120A, 120B and connect the body armor plates 120A, 120B of various sizes to the plate frames 110A, 110B. Additionally or instead, the tabs 112A-G and 114A-G may be adjusted within the holes 180 outward from and inward towards the plate frame portions 110A and 110B in which they are disposed (and locked into place once they are in the desired position) to allow different widths and lengths of body armor plates 120A, 120B to be attached to the plate frame portions 110A, 110B via the adjustable tabs 112A-G, 114A-G.

The different tabs 112A-G and 114A-G may be attached to the holes in the plate frame portions 10A, 10B, respectively, by any attachment mechanism known to those skilled in the art for attaching removable or adjustable tabs to a frame. The tabs 112A-G and 114A-G may be insertable into their corresponding holes in the plate frame portions 110A, 110B and locked therein by the attachment mechanism, but remain detachable and removable from the holes as desired or needed by the user.

Figure 16:
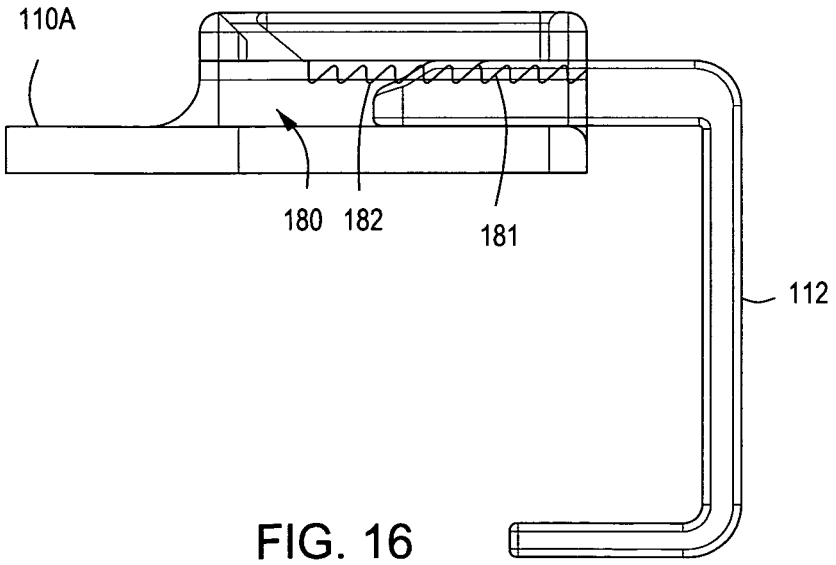
FIG. 16 is a left side cross-sectional view of the front tab assembly of FIG. 14 with a front tab inserted into a front slot.
Figure 15:
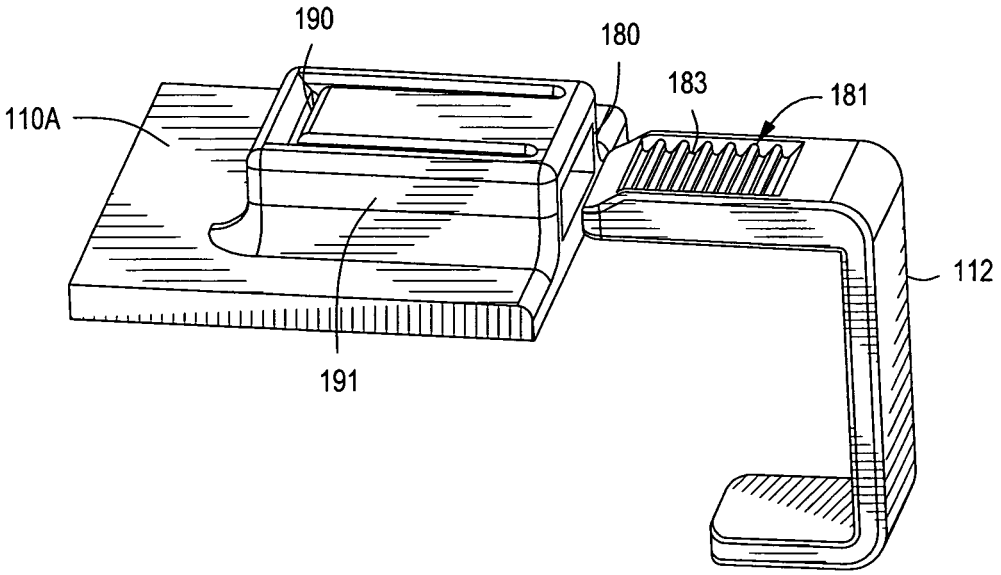
FIG. 15 is a left side perspective, exploded view of a front tab assembly of FIG. 14.
Figure 17:
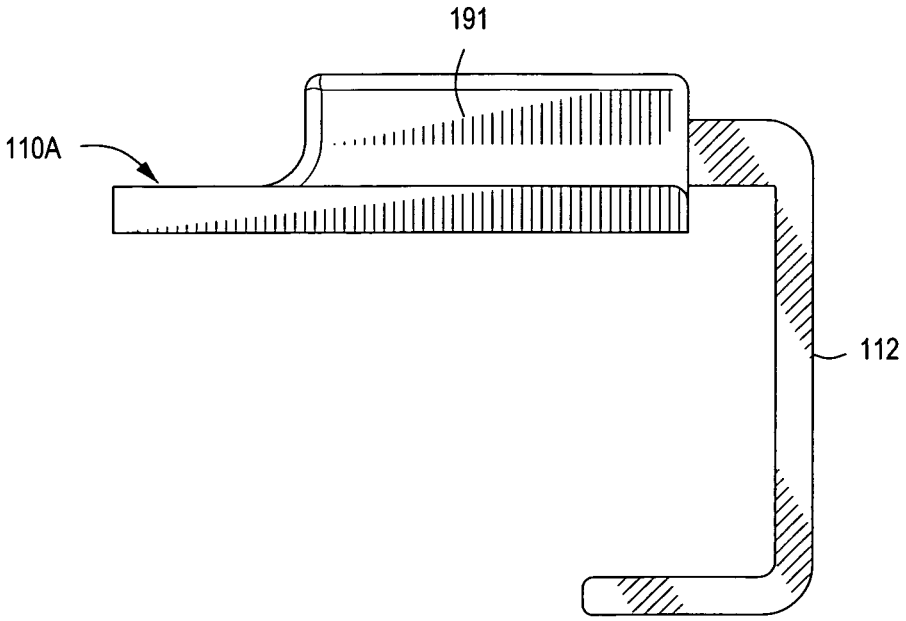
FIG. 17 is a left side view of the front tab assembly of FIG. 16 with the front tab inserted into the front slot.

An example attachment mechanism may be a flexible tooth over an opposing tooth (much like a ziptie). One example is shown in FIGS. 14-17, including an example adjustable tab 112 with its corresponding hole 180 in the plate frame portion 110A (only a section of the plate frame portion 110A is shown in FIGS. 14-17), e.g., a hole 180 in the raised portion 191 of the plate frame portion 110A. The adjustable tab 112 may have teeth 181, and the hole 180 may have corresponding teeth 182 so that when the teeth 181 and 182 are positioned in line with one another so that corresponding teeth 181, 182 are in contact with one another, the teeth 182 are housed in divots 183 between the teeth 181 while the teeth 181 are housed in divots 184 between teeth 182, as shown in FIG. 16. The teeth 181, 182, when in engagement with one another, prevent the tab 112 from becoming dislodged from the hole 180 and ultimately allow the tab 112 to securely hold the body plate portion 120A with the plate frame portion 110A. The hole 180 in the raised portion 191 may, for example, be generally rectangular or box-shaped, but it may instead be any shape which allows the tab 112 to connect to the plate frame portion 110A using the hole 180. The "top" of the raised portion 191, e.g., the top of the box, may include a partially cut-out portion at least partially surrounding the teeth 182 forming a tongue 190, the partially cut-out portion being three sides of a rectangle or box in one embodiment shown in FIG. 15. The tongue 190 remains biased closed until acted upon by an opposing force to permit disengagement of the tab 112 from the plate frame portion 110A.

To lock the tab 112 in place with respect to the plate frame portion 110A, an end of the tab 112 is inserted into the hole 180 in the plate frame portion 110A, and the tab 112 is moved with respect to the hole 180 until the teeth 181, 182 engage one another appropriately, for example as shown in FIG. 16 when the teeth 181 are disposed within the hole 180. To move the tab 112 with respect to the hole 180, the tongue 190 may be levered or raised (e.g., by the user pulling on the tongue 190 with an opposing force), and to lock the tab 112 into place within the hole 180, the tongue 190 opposing force may be released. The locked, engaged teeth 181, 182 (disposed within divots 184, 183 respectively) prevent the tab 112 from moving within the hole 180 with respect to the plate frame portion 110A. The tab 112 may be adjusted within the hole 180 by also levering or raising the tongue 190 and moving the tab 112 with respect to the hole 180 to a different position, and then releasing the opposing force on the tongue 190 to again lock the adjusted tab 112 into place. To unlock the tab 112 and remove it from the plate frame portion 110A, the tongue is levered, e.g., an opposing force is exerted on the tongue 190 to counteract the bias force of the tongue 190 (e.g., by the user pulling on the tongue), the teeth 182 are raised with respect to the teeth 181 thereby disengaging the teeth 181, 182 from one another, and the tab 112 may be moved or pulled out of the hole 180. Another tab which may be of a different size than tab 112 (to allow for attachment of a different body armor plate to the plate frame portion) may then be inserted into the hole 180 and locked into place as described above.

The other tabs 112, 114 and holes in the plate frame portions 110A, 110B may be configured and operate in the same way as shown and described with respect to the tab 112 and hole 180 of FIGS. 14-17.

The attachment mechanism shown in FIGS. 14-17 may be a low profile design without any snag hazards (corners of the raised portion 191 are smooth to prevent their catching on anything) or any chance to accidentally release the tab. Any other attachment mechanism used in lieu of the example attachment mechanism shown in FIGS. 14-17 may also include a low profile design without any snag hazards or any chance to accidentally release the tab.

Although different tabs may be swapped out, it is also within the scope of embodiments that the same tabs 112, 114 may be adjusted without swapping them out by manipulating the appropriate tongue 190, moving the tab 112 and/or 114 to the appropriate location with respect to the hole 180, and locking the tab 112 and/or 114 into place at some location where at least some of the teeth 181, 182 are engaged with one another by allowing the biasing force to force the tongue 190 into the direction of the tab 112 or 114. In this way, the width and length of the body plates 120A, 120B may be adjusted for without the need for complete removal and replacement of the tabs 112, 114.

Figure 11:
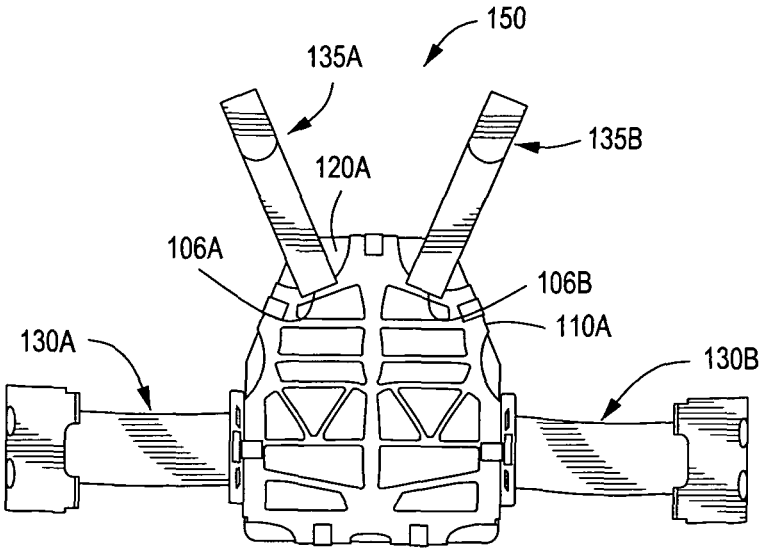
FIG. 11 is front view of a second embodiment of a plate frame assembly with a cummerbund strap detached.
Figure 12:
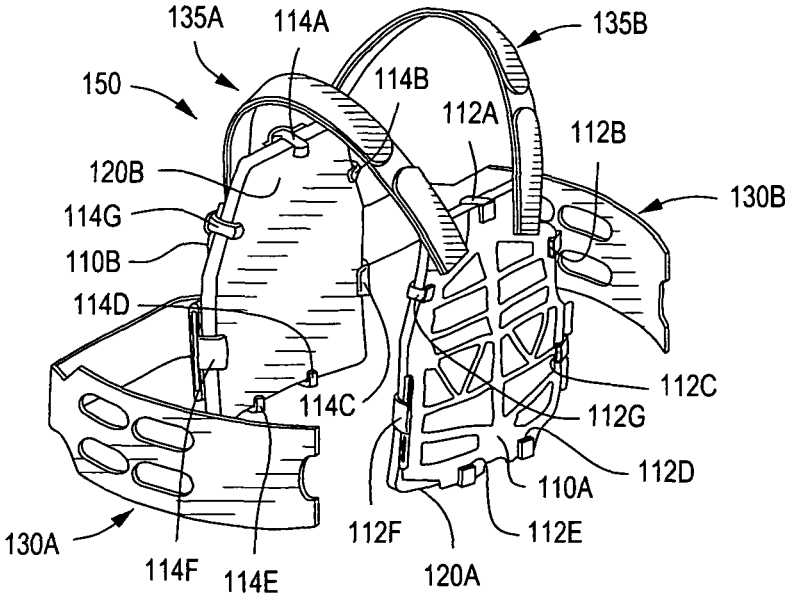
FIG. 12 is a left side perspective view of the plate frame assembly of FIG. 11.
Figure 13:
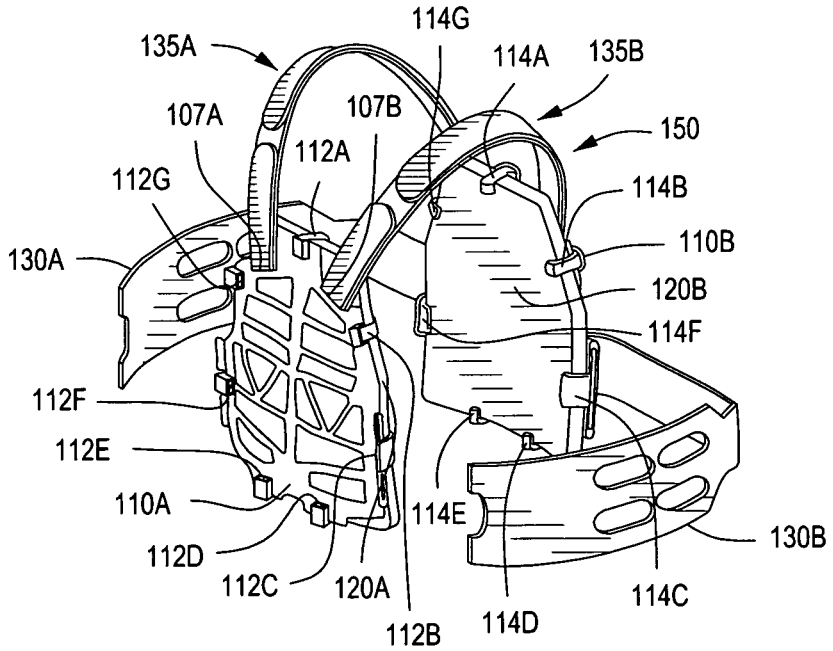
FIG. 13 is a right side perspective view of the plate frame assembly of FIG. 11.
Figure 14:
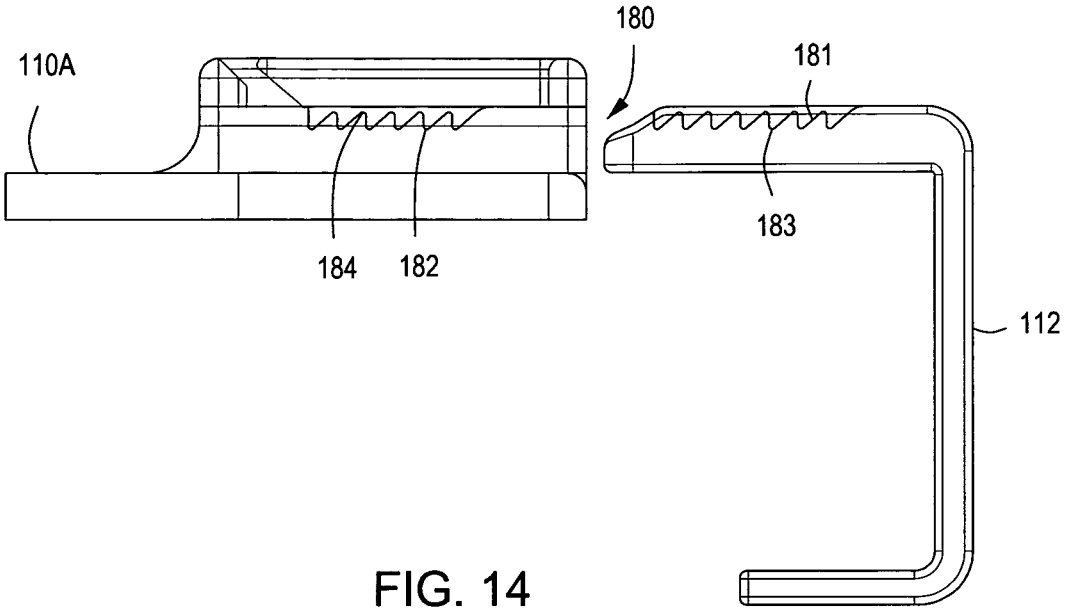
FIG. 14 is a left side exploded, cross-sectional view of a front tab assembly of the plate frame assembly of FIG. 11.

The plate frame assembly 150 also may include one or more attachment straps 135A, 135B similar in structure and function to the shoulder straps 35A, 35B described herein with respect to the plate frame assembly 50. The shoulder straps 135A, 135B may be threaded through holes 106A, 106B (which are similar in structure and function to holes 6A, 6B described with respect to the plate frame assembly 50) in the plate frame portion 110A as well as corresponding holes (not shown, but similar in structure and function to holes 7A, 7B described with respect to the plate frame assembly 50) in the plate frame portion 110B. More specifically, an end of the shoulder attachment strap 135A is disposed through the hole 106A and an other end of the shoulder attachment strap 135A is disposed through the corresponding hole 107A in the plate frame portion 110B, and an end of the shoulder attachment strap 135B is disposed through the hole 106B and an other end of the shoulder attachment strap 135B is disposed through the corresponding hole 107B in the plate frame portion 110B. The ends of each attachment strap 135A, 135B may be looped through their respective holes as shown in FIGS. 11-13 and attached to an overlapping portion of the attachment strap 135A, 135B, e.g., via welding the straps 135A, 135B to themselves, welding or fusing one or more hook and loop fasteners to the attachment straps 135A, 135B and attaching the hook and loop fasteners to one another as known to those skilled in the art, or fusing the straps 135A, 135B to themselves (as described with respect to the attachment straps 35A, 35B).

The plate frame assembly 150 may also include one or more cummerbund attachment straps 130A, 130B similar in structure and function to the cummerbund attachment straps 30A, 30B described herein with respect to the plate frame assembly 50. The tabs 112C and 112F on the bottom sides of the first plate frame portion 110A, as well as the tabs 114C and 114F on the bottom sides of the second plate frame portion 110B may each include one or more holes therein for looping the end of the cummerbund straps 130A, 130B therethrough, similar to the way that the cummerbund straps 30A, 30B are looped through the holes 8A, 8B, 9A, 9B in the plate frame portions 50A, 50B of the plate frame assembly 50. More specifically, an end of the cummerbund attachment strap 130A is disposed through the hole(s) associated with the tab 112F and an other end of the cummerbund attachment strap 130A is disposed through the corresponding hole(s) associated with the tab 114F, and an end of the cummerbund attachment strap 130B is disposed through the hole(s) associated with the tab 112C and an other end of the cummerbund attachment strap 130B is disposed through the corresponding hole(s) associated with tab 114C. The ends of each attachment strap 130A, 130B may be looped through their respective holes and attached to an overlapping portion of themselves, e.g., via welding the straps 130A, 130B to themselves, welding one or more hook and loop fasteners to the attachment straps 130A, 130B and attaching the hook and loop fasteners to one another as known to those skilled in the art, or fusing the straps 130A, 130B to themselves (as described with respect to the attachment straps 30A, 30B).

In operation, each body plate portion 120A, 120B may be attached to its respective plate frame portion 110A, 110B using the appropriately sized tab 112A-G, 114A-G for securely holding the body plate portion 120A, 120B in place with respect to the appropriate plate frame portion 110A, 110B. The appropriate body plate 120A, 120B may be selected and placed in position with respect to its respective plate frame portion 110A, 110B for attachment thereto. The appropriately-sized tabs 112, 114 which allow secure, fixed engagement of the body plate portions 120A, 120B with respect to the plate frame portions 110A, 110B may then be inserted into the appropriate holes in the plate frame portion 110A, 110B until the teeth 181, 182 engage one another to lock the tabs 112, 114 into position with respect to the plate frame portions 110A, 110B and thereby lock the body plate portions 120A, 120B in place with respect to their respective plate frame portions 110A, 110B. In some embodiments, some of the tabs 112, 114 may be placed into locking engagement with the plate frame portions 110A, 110B prior to placing the body plate portions 120A, 120B into position with respect to the body plate portions 120A, 120B, and some of the tabs 112, 114 may be placed into locking engagement with the plate frame portions 110A, 110B after the body plate portions 120A, 120B are placed in position with respect to the plate frame portions 110A, 110B (e.g., only the tabs 112D-E, 114D-E on the bottom of the plate frame portions 110A, 110B may be placed in locking engagement with the plate frame portions 110A, 110B, the body plate portions 120A, 120B may then be positioned with respect to their respective plate frame portions 110A, 110B, and then the remaining tabs 112A-C, 112F-G, 114A-C, and 114F-G may be placed in locking engagement with the appropriate holes in the plate frame portions 110A, 110B).

After the desired tabs 112, 114 are inserted to the desired extent through the holes 180 in the plate frame portions 110A, 110B, the cummerbund attachment straps 130A, 130B may be threaded through the appropriate holes in the tabs 112F, 114F, 112C, 114C as described above, and the shoulder attachment straps 135A, 135B may be threaded through the appropriate holes in the plate frame portions 110A, 110B as also described above. (In an alternate embodiment, any or all of the straps 130A, 130B, 135A, 135B may be threaded through its/their intended hole(s) and secured prior to the addition of the tabs 112, 114 to the plate frame portions 110A, 110B and/or prior to the attachment of the body plate portions 120A, 120B to the plate frame portions 110A, 110B.) Once the ends of the straps 130A, 130B, 135A, 135B are looped through their intended holes, the straps 130A, 130B, 135A, 135B may each be secured to themselves at their overlapping portions via welding, welding or fusing hook and loop fasteners to the straps 130A, 130B, 135A, 135B and attaching the hook and loop fasteners to one another as known to those skilled in the art, or fusing as described in relation to the strap attachment of the plate frame assembly 50 of FIGS. 4-8.

The plate frame assembly 150 may be worn on the user as shown and described in relation to FIG. 7 with respect to the plate frame assembly 50. Equipment such as tactical equipment, pouches, pockets, etc. (any of the equipment shown and described in relation to attachment to the plate frame assembly 50) may be attached to the plate frame assembly 150 at one or more of its plate frame portions 110A, 110B (e.g., via the holes in the plate frame portions 110A, 110B) in much the same manner as shown and described in FIG. 8 in relation to the plate frame assembly 50.

The plate frame assembly 150 and its associated components may be made from the same types of material as described herein in relation to the plate frame assembly 50 and its associated components, and the components of the plate frame assembly 150 may be attached to one another in much the same way as components described in relation to the plate frame assembly 50. Optionally, the one or more bladders 40, 45 may be incorporated in and used with the plate frame assembly 150 in the same way as described in relation to the plate frame assembly 50.

The ability to switch out and adjust the tabs/extensions/hooks of the plate frame 110 gives modularity to different body armor plates. The tabs/extensions/hooks are generally not flexible and may in one example be made of rigid plastic. Although the tabs/extensions/hooks are described herein using one example connection member and method (teeth), it is within the scope of embodiments that any connection or fastening method or members known to those skilled in the art which allow the plate frame and extensions/tabs/hooks to connect to one another in a stable, fixed manner and snap or lock into place and also permit the extensions/tabs/hooks to slide back and forth with respect to the plate frame and adjust may be utilized in embodiments in lieu of or in addition to the teeth connection method/members described herein.

The cummerbund attachment straps 130A, 130B are not limited to being worn around the waist area or typical cummerbund coverage area of the user, but may be worn around the user at any location. The shoulder support straps 135A, 135B are merely examples of a shoulder supporting member for the plate frame assembly. Instead of the shoulder support straps 135A, 135B, any type of shoulder supporting member which allows the plate frame assembly 150 to be supported by the shoulders of a user may be utilized with the plate frame assembly 150, and the shoulder supporting member is not limited to straps.

Figure 18:
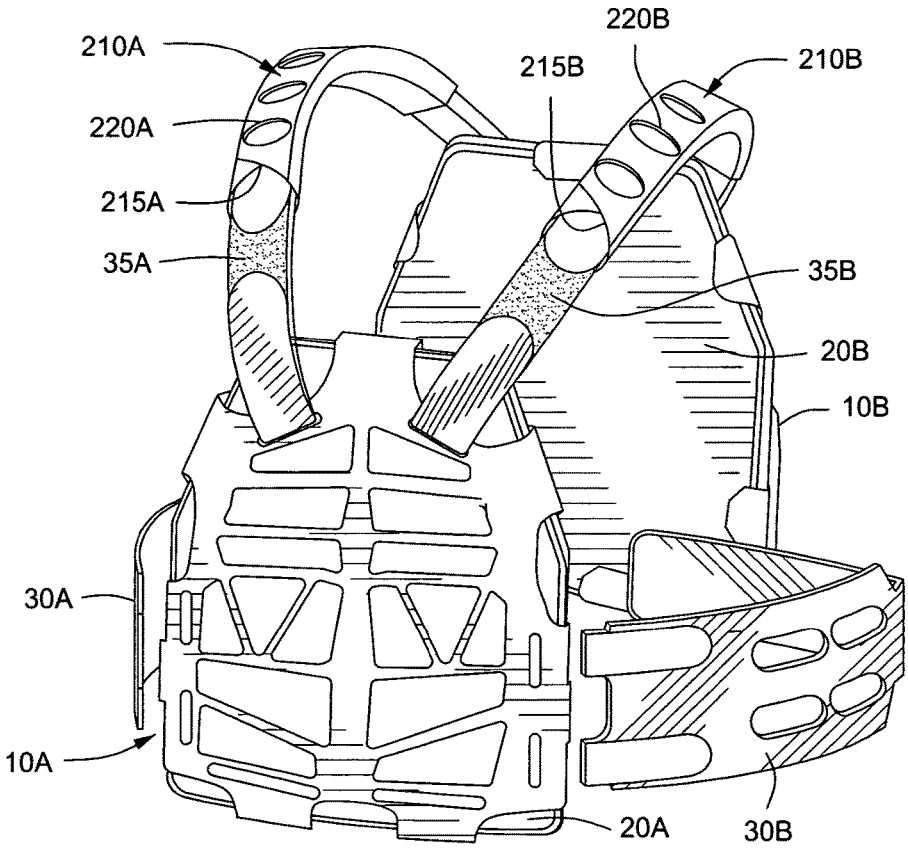
FIG. 18 is a front side perspective view of a third embodiment of a plate frame assembly with a cummerbund strap detached.
Figure 19:
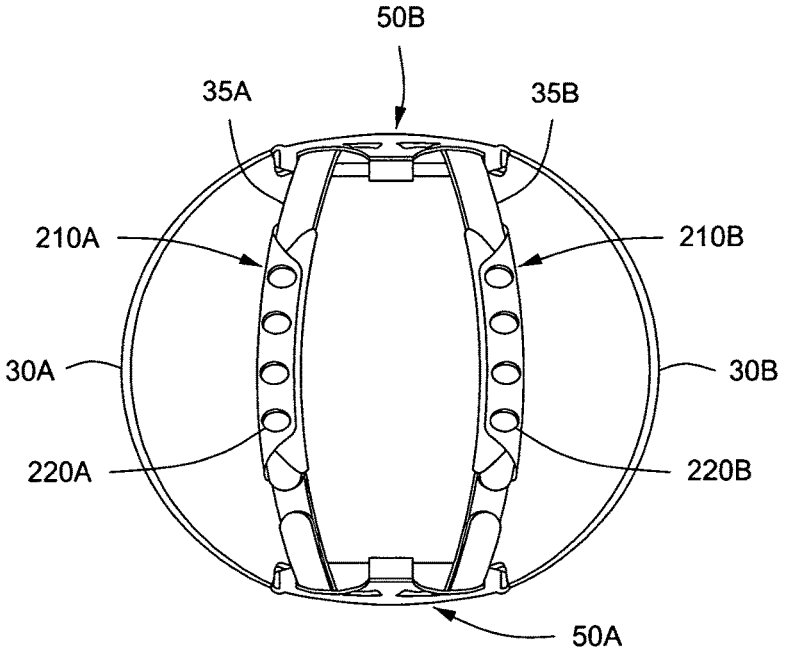
FIG. 19 is a top plan view of the plate frame assembly of FIG. 18.
Figure 20:
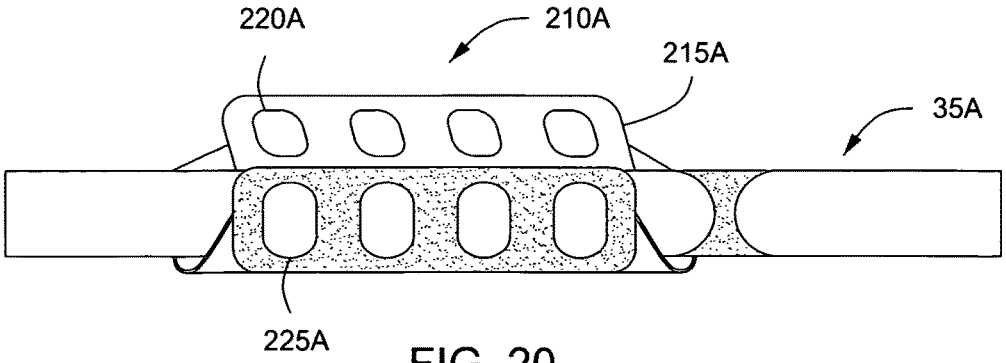
FIG. 20 is a section view of a shoulder strap assembly of the plate frame assembly of FIG. 18.

FIGS. 18, 19, and 20 show a third embodiment of the plate frame assembly. This third embodiment includes one or more optional shoulder strap supplementing members 210A and 210B. Each shoulder strap supplementing member 210A, 210B includes an elongated body having a longitudinal hole running therethrough for inserting its respective shoulder attachment strap 35A or 35B therethrough, as shown in FIGS. 18 and 19. The shoulder strap supplementing member 210A acts as a sleeve for the shoulder attachment strap 35A, and the shoulder strap supplementing member 210B acts as a sleeve for the shoulder attachment strap 35B. The shoulder strap supplementing members 210A, 210B may each have a hole width which is larger than the width of the shoulder supporting member 210A, 210B which will run therethrough, but small enough to prevent the shoulder supporting member 210A or 210B from slipping relative to the shoulder attachment strap 35A or 35B. The shoulder strap supplementing members 210A, 210B may each be padding members for padding the shoulders of the user and in some examples which are not limiting of embodiments may include a coated foam pad (and may include material surrounding the foam pad which is similar or the same as the material forming the shoulder attachment straps and/or cummerbund attachment straps described herein).

In some embodiments, the shoulder strap supplementing members 210A, 210B may include one or more holes 220A, 220B, respectively, through the top portions thereof, as shown in FIGS. 18, 19, and 20. These holes 220A, 220B may rest on the top of the shoulder supporting straps as shown in FIGS. 18 and 19 (but it is also within the scope of embodiments that they may be formed in other locations on the shoulder strap supporting members 210A, 210B). The one or more holes 220A, 220B through the top portions of the shoulder strap supplementing members 210A, 210B may serve as stabilizing forces and/or as routing members for certain attachments to the plate frame assembly 50. For example, one or more tubes, wires, or cables from a hydration system (e.g., the backpack 67 shown in FIG. 8) such as a camelback or a radio (or from any other accessories or attachments to the plate frame assembly 50 or its associated components) may be run through the one or more holes 220A, 220B (and holes 225A, 225B as shown and described in relation to FIG. 20) through the top of the shoulder strap supplementing members 210A, 210B. In one example, a tube for delivering water from a hydration system or backpack 67 to the user may be threaded through the hole 220A or 220B (or both or a plurality of the holes) (and through 225A, 225B as shown and described in relation to FIG. 20) for easy and directable delivery of the water-delivering portion of the tube to the user.

FIG. 20 illustrates a portion of the shoulder attachment strap 35A with the shoulder strap supplementing member 210A partially wrapped around it. The shoulder strap supplementing member 210A is shown in the open position to depict a method of placement of the shoulder attachment strap 35A in the shoulder strap supplementing member 210A. The shoulder strap supplementing member 210A may be attached to itself at its overlapping portions when it is wrapped around the shoulder attachment strap 35A, e.g. by one or more hook and loop fasteners such as Velcro® attached to the mating surfaces of the shoulder strap supplementing member 210A. As shown in FIG. 20, the shoulder strap supplementing member 210A may include one or more holes 220A in one end and one or more holes 225A in its other end which overlap and line up with one another when the shoulder strap supplementing member 210A is wrapped around the shoulder attachment strap 35A and the overlapping portions of the shoulder strap supplementing member 210A are appropriately positioned and connected to one another (this aligned and connected position is shown in FIGS. 18 and 19, where side flaps 215A, 215B are placed in contact with the other sides of the respective shoulder strap supplementing members 210A, 210B). Although FIG. 20 shows only one shoulder attachment strap 35A and only one shoulder strap supplementing member 210A, the other shoulder attachment strap 35B and shoulder strap supplementing member 210B are configured and act in the same manner as described in relation to FIG. 20).

FIG. 18 shows the optional hook and loop fasteners which may be located on at least a portion of at least one side of the shoulder attachment strap(s) 35A, 35B, indicated by the dots, to attach the straps 35A, 35B at their overlapping portions.

The shoulder strap supplementing members 210A, 210B and other features depicted in FIGS. 18-20, although shown in relation to the first embodiment of the plate frame assembly 50 of FIGS. 1-8, may also be integrated with and used in the same manner with the plate frame assembly 150 shown and described herein in relation to FIGS. 11-17.

Embodiments disclosed herein provide a plate frame which holds body armor, is lighter, and is more streamlined than prior art vests. The plate frame is capable of holding accessory pouches and providing access to accessory pouches and other attachments to the plate frame.

The sizes, shapes, and dimensions of components which are described herein are merely exemplary, and any sizes, shapes, and dimensions of components which accomplish the intended purposes of the components are within the scope of embodiments.

While the foregoing is directed to embodiments, other and further embodiments of the invention may be devised without departing from the basic scope thereof, and the scope thereof is determined by the claims that follow.

The invention claimed is:

1. A plate carrier wearable by a user, comprising:

a rigid plate frame including an inner surface that faces the user when the plate carrier is worn by the user and an outer surface that faces away from the user when the plate carrier is worn by the user, the rigid plate frame configured to hold one or more ballistic body armor plates between the inner surface and the user, with the one or more ballistic body armor plates at least partially housed in the rigid plate frame and held in a fixed position with respect to the rigid plate frame; and a plurality of rigid extensions extending from an outer perimeter of the rigid plate frame, the plurality of extensions configured to hold the one or more body armor plates in the fixed position with respect to the rigid plate frame, the rigid plate frame having one or more built-in features for securing tactical equipment thereto, the one or more built-in features including voids formed in the rigid plate frame;

the rigid plate frame comprises a first plate frame portion configured to be worn on the user's chest and a second plate frame portion configured to be worn on the user's back, the first plate frame portion at least partially houses a first body armor plate and holds the first body armor plate in a fixed position with respect to the first plate frame portion, the first body armor plate configured to be positioned between an inner surface of the first plate frame portion and the user's chest, and the second plate frame portion at least partially houses a second body armor plate and holds the second body armor plate in a fixed position with respect to the second plate frame portion, the second body armor plate configured to be positioned between an inner surface of the second plate frame portion and the user's back.

2. The plate carrier of claim 1, wherein the plurality of extensions include one or more adjustable hooks which are adjustable to accommodate different dimensions of the one or more body armor plates.

3. The plate carrier of claim 1, wherein: the first plate frame portion comprises one or more first extensions extending from an outer perimeter of the first plate frame portion to hold the first body armor plate in the fixed position, and the second plate frame portion comprises one or more second extensions extending from an outer perimeter of the second plate frame portion to hold the second body armor plate in the fixed position.

4. The plate carrier of claim 1, further comprising one or more shoulder attachment straps extending through the first plate frame portion and the second plate frame portion to connect the first and second plate frame portions to one another and to provide shoulder straps to allow the plate carrier to be supported by a user's shoulders, wherein, each shoulder attachment strap is attached to an overlapping portion of the respective shoulder attachment strap when extending through the first and second plate frame portions to secure the shoulder attachment strap to the respective plate frame portion.

5. The plate carrier of claim 4, wherein the one or more shoulder attachment straps are made of a non-porous, liquid and chemical resistant material and each shoulder attachment strap is attached to the overlapping portion of the respective shoulder attachment strap.

6. The plate carrier of claim 1, further comprising one or more cummerbund attachment straps extending through the first plate frame portion and the second plate frame portion to connect the first and second plate frame portions to one another and to provide straps around a torso of the user to stabilize the plate frame assembly around the user, wherein, each cummerbund attachment strap is attached to an overlapping portion of the respective cummerbund attachment strap when extending through the first and second plate frame portions to secure the cummerbund attachment strap to the respective plate frame portion.

7. The plate carrier of claim 1, wherein the one or more features for securing tactical equipment thereto include a modular attachment system integrated in the rigid plate frame, the modular attachment system comprising one or more holes in the rigid plate frame for securing one or more attachments thereto.

8. The plate carrier of claim 1, further comprising the one or more ballistic body armor plates.

* * * * *